US006920959B2

(12) United States Patent
Han et al.

(10) Patent No.: US 6,920,959 B2
(45) Date of Patent: Jul. 26, 2005

(54) INLET AND OUTLET DUCT UNITS FOR AIR SUPPLY FAN

(75) Inventors: Ming Hui Han, Mississauga (CA); Pradeep Guar, Brampton (CA)

(73) Assignee: M & I Heat Transfer Products Ltd., Mississauga (CA)

( * ) Notice: Subject to any disclaimer, the term of this patent is extended or adjusted under 35 U.S.C. 154(b) by 0 days.

(21) Appl. No.: 10/449,466

(22) Filed: May 30, 2003

(65) Prior Publication Data

US 2004/0238271 A1 Dec. 2, 2004

(51) Int. Cl.[7] ..... E04F 17/04; F01N 1/24; F24F 13/24

(52) U.S. Cl. ..... 181/224; 181/225; 181/222; 181/252; 181/256; 454/262; 454/906; 454/346

(58) Field of Search ..... 181/224–226, 181/218, 222, 248, 252, 256, 258, 267; 454/262, 906, 206, 351, 346–348, 352, 268; 415/119

(56) References Cited

U.S. PATENT DOCUMENTS

| | | | | |
|---|---|---|---|---|
| 2,916,101 A | | 12/1959 | Naman | |
| 2,987,982 A | * | 6/1961 | Wilson | 454/265 |
| 2,990,906 A | * | 7/1961 | Audette | 181/256 |
| 3,033,307 A | | 5/1962 | Sanders et al. | |
| 3,435,911 A | | 4/1969 | Greenheck | |
| 3,568,791 A | | 3/1971 | Luxton | |
| 3,688,865 A | * | 9/1972 | Smith et al. | 181/218 |
| 3,739,872 A | | 6/1973 | McNair | |
| 3,841,434 A | * | 10/1974 | Culpepper Jr. | 181/224 |
| 3,960,063 A | | 6/1976 | Siemes et al. | |
| 4,068,736 A | * | 1/1978 | Dean et al. | 181/224 |
| 4,167,986 A | * | 9/1979 | Conway | 181/224 |
| 4,266,602 A | | 5/1981 | White et al. | |
| 4,362,223 A | | 12/1982 | Meier | |
| 4,573,551 A | | 3/1986 | Schwerdtner et al. | |
| 4,872,398 A | | 10/1989 | Shen | |
| 4,986,170 A | | 1/1991 | Ramakrishnan et al. | |
| 5,140,819 A | | 8/1992 | Napier et al. | |
| 5,491,308 A | | 2/1996 | Napier et al. | |
| 5,709,529 A | * | 1/1998 | Parzych | 415/119 |
| 5,728,979 A | | 3/1998 | Yazici et al. | |
| 5,817,990 A | * | 10/1998 | Furse | 181/224 |
| 5,861,585 A | | 1/1999 | Van Every et al. | |
| 5,983,888 A | * | 11/1999 | Anselmino et al. | 126/299 R |
| 6,035,964 A | | 3/2000 | Lange | |

(Continued)

FOREIGN PATENT DOCUMENTS

| | | | | |
|---|---|---|---|---|
| DE | 05 3401210 | | 7/1985 | |
| GB | 2031062 A | * | 4/1980 | F01N/1/24 |
| GB | 2250356 A | * | 6/1992 | F16D/1/04 |
| JP | 63286647 A | * | 11/1988 | F24F/13/02 |

*Primary Examiner*—Edgardo San Martin
(74) *Attorney, Agent, or Firm*—Lipsitz & McAllister, LLC

(57) ABSTRACT

Duct units for delivery of air to an air supply fan and for connecting this fan to an air heater unit are disclosed. The duct unit for delivering air in one version has a narrow first section, a second, transition-type section and a wide sound attenuating, third section with these three sections extending generally vertically. Spaced apart splitters containing sound attenuating material and having side walls of perforated metal are mounted in the third section. The splitters include a central splitter and outer splitters with the latter converging inwardly towards a central axis of the third section. This duct unit also has an elbow-shaped duct section connected to the third section at its upstream end and connectible to the fan at its downstream end. In another version, the duct unit has a single, elongate splitter that extends longitudinally along at least a major portion of a second duct section and that bends through a smooth curve. The outlet duct apparatus has an elbow section of duct that bends through a smooth curve and an elongate second section connected to the elbow section. An elongate turning vane is mounted in the outlet duct and has a substantially curved first vane section and a second vane section that extends substantially upwardly.

29 Claims, 16 Drawing Sheets

U.S. PATENT DOCUMENTS 6,267,665 B1 7/2001 Akhtar
6,419,576 B1 7/2002 Han
6,533,657 B2 * 3/2003 Monson et al. ..... 454/346
6,537,490 B2 * 3/2003 Han ..... 415/119
2002/0011065 A1 1/2002 Nishimura et al.
2002/0050418 A1 5/2002 Jenvey
2002/0084138 A1 7/2002 Weinstein
2002/0182061 A1 12/2002 Han

* cited by examiner

INLET AND OUTLET DUCT UNITS FOR AIR SUPPLY FAN

BACKGROUND OF THE INVENTION

This invention relates generally to duct units, including sound attenuating duct units for transferring air or gases to a fan unit, including such duct units for delivering air to and from an air supply fan unit for use in conjunction with air heaters, such as those used in boiler systems.

It is known to provide large utility and industrial boilers (steam generators) which are used for power and co-generation. These boilers can be oiled fired with water tubes extending through the boiler and the water therein being heated by means of suitable air heaters. Large amounts of combustion air can be provided to these air heaters by means of a forced draft fan unit (herein sometimes referred to as a "FD fan"). This fan unit is powered electrically and can be arranged to rotate about a horizontal axis. It is known to deliver fresh air from the atmosphere through a long, vertically extending air duct that may include a splitter-type sound attenuating section. In a known air delivery system, the incoming air must change its direction through a substantial angle and must pass through a so-called trap section prior to moving horizontally into the fan inlet section.

It is also known to provide an air delivery duct that extends from the outlet of the FD fan to the bottom of an air heater unit for the boiler which can be located a substantial distance above the FD fan. The known outlet duct for the FD fan includes an elbow section in which the pressurized air flow is turned through a substantial bend typically in the order of 90 degrees. There is then an elongate duct section above the elbow section which extends upwardly and which has diverging sidewalls.

Some known difficulties or deficiencies with the duct systems for delivering air to the FD fan and for delivering the pressurized air from the fan to the air heater of the boiler include substantial power consumption for the fan, relatively high operational noise created in the vicinity of the fan unit, relatively poor air flow distribution across the air heater or air heaters and duct vibrations.

In one conventional system for an inlet duct providing combustion air to an FD fan, there is a standard splitter silencer which has an open area across the transverse cross-section of the duct between 45 and 55%. Because of the configuration of these known silencers and because air follows the path of least resistance through an air duct, the flow through the passageways formed by the splitters is not uniform. There is in fact a biased flow in the center of the splitter silencer which results in increased pressure drop across the silencer that is directly proportional to the change in the face velocity. There can also be airflow induced vibrations in the inlet duct unit due to a sudden change in the velocity of air.

With respect to the conventional form of connecting duct between the FD fan and the air heaters of the boiler, the conventional duct system does not provide a smooth flow of the high velocity air from the fan unit. The air flow from the fan can have a velocity of between 5,000 and 6,000 feet per minute and due to the sharp bend in the air duct, this air strikes the inner wall of the duct in the elbow region with substantial force. The reaction to this high velocity air creates a flow barrier and also creates very high turbulence in the transition section above the elbow section. This turbulence causes a very high pressure drop and noise in the duct. For example, a typical pressure drop in a duct having a length of 35 to 40 feet that extends between the fan and the steam coil air heater (SCAH) can be between 6 and 7 inches W.G. Also, the air flow distribution across the air heater is not uniform.

Examples of air duct silencers are found in U.S. Pat. No. 5,728,979 which issued Mar. 17, 1998 to Air Handling Engineering Ltd., these silencer units being designed for use both at the inlet end and at the outlet end of a fan unit. Each silencing apparatus has an exterior housing with an air inlet and an air outlet, one of which is connected to the fan unit. The inlet and outlet of the silencer are connected by an air flow passageway which is defined by perforated interior walls of the housing. One of these silencer units includes first and second series of splitters with the splitters in each series being spaced apart to form smaller air passageways and mounted side-by-side in a row.

In another form of outlet duct unit described in this U.S. patent, the primary passageway bends through a substantial angle of about 90 degrees from the inlet of the silencer to the outlet end. Two similar splitters are arranged in a downstream section of the silencer unit. In the bent section of the silencer unit, there are several curved splitters which also extend through a bend of about 90 degrees and one of these is a centrally located splitter.

It is an object of the present invention to provide an improved sound attenuating duct unit for delivery of air or gases to an inlet of a fan unit which unit is both good at reducing sound levels from the duct unit and fan and provides pressure drop savings.

It is a further object of the present invention to provide an improved outlet duct apparatus for connecting an outlet of an air supply fan to an air heater unit, such as one used in a boiler, this duct apparatus providing good static pressure regain and good pressure drop savings.

SUMMARY OF THE INVENTION

According to a first aspect of the invention, a sound attenuating duct unit for delivering air or gases to an inlet of a fan unit includes an elongate duct for transferring air or gases to the fan inlet. This duct has duct walls and includes a narrow first section, a second, transition-type expanding section having one end connected to an adjacent end of the first section and an opposite second end, and a relatively wide, sound attenuating third section connected to the second end of the second section. The elongate duct is adapted to extend substantially vertically with the first section on top and the third section at a bottom end thereof. The third section has two opposite first and second side walls that taper towards each other in the direction of air or gas flow through the elongate duct, this direction being downwardly during use of the duct unit. The third section also has a plurality of spaced-apart splitter members containing sound attenuating material and having side walls made of perforated sheet metal. The splitters are substantially planar, are elongate in the direction of air or gas flow, and are connected to the walls of the duct. The splitters include at least one central splitter and outer splitters, the latter converging inwardly towards a central longitudinal axis of the third section from their upstream ends to their downstream ends. The central longitudinal axis extends at an acute angle to a vertical axis intersecting the central longitudinal axis. The duct unit also has an elbow-shaped duct section having an upstream end adapted for connection to the third section and a downstream end adapted for connection to the air supply fan unit.

Preferably the second expanding section has two opposite side walls that diverge from each other and from the central longitudinal axis in the direction of air or gas flow.

According to another aspect of the invention, a sound attenuating duct unit for delivery of air or gases to an inlet of an air supply fan unit includes an elongate first duct section for transferring air or gases from an inlet end thereof to an opposite end. There is also an elongate second duct section having an upstream first end adapted for connection to the opposite end of the first duct section and a downstream second end. The second duct section bends through a smooth curve between the first end and the second end, the amount of bending being less than 90 degrees. An upper section of the second duct section extends substantially vertically during use of the duct unit. An elongate splitter is rigidly mounted in the second duct section and contains sound attenuating material. The opposite side walls of the splitter are made of perforated sheet metal and the splitter extends longitudinally along at least a major portion of the second duct section. The splitter is located centrally in the second duct section and bends through a smooth curve between first and second ends of the splitter. The amount of bending in the splitter corresponds proportionally to the bending in the second duct section. A third duct section has an upper end adapted for connection to the second end of the second duct section during use of the duct unit and has a horizontally extending portion adapted for connection to the inlet of the air supply fan. The third duct section during use thereof causes a substantial change in direction of flow of the air or gases flowing through the duct unit, this change in direction of flow being less than 90 degrees.

Preferably an intake baffle is fixedly mounted in the third duct section and extends about a central axis of the horizontally extending portion of the third duct section. The baffle is spaced radially away from the central axis.

According to another aspect of the invention, an outlet duct apparatus for connecting an outlet of an air supply fan unit to an air heater unit, such as one used in a boiler, includes an elbow section of duct for transferring air from an inlet end connectable to the air supply fan unit to an opposite end of the elbow section. The elbow section bends through a smooth curve between the inlet end and the opposite end, the amount of bending being more than 60 degrees and preferably about 90 degrees. An elongate second section of the duct has an upstream first end connected to the opposite end of the elbow section and has a downstream second end which is substantially wider than the first end and is connectible to the air heater unit during use of the outlet duct apparatus for delivery of combustion air through an intake for the air heater unit. A turning vane is rigidly mounted in the outlet duct apparatus and has a curved first vane section located centrally in the elbow section and an adjoining second vane section located in the second section of duct. The second section of the duct and the second vane section extend upwardly during use of the outlet duct apparatus. There is a smooth transition between the first and second vane sections on both a front side and a rear side of the turning vane.

In one variation of this outlet duct apparatus, the turning vane contains sound attenuating material and has opposite curved sides made of perforated sheet metal which covers the sound attenuating material.

Further features and advantages of the duct units of this invention will become apparent from the following detailed description taken in conjunction with the drawings.

DETAILED DESCRIPTION OF PREFERRED EMBODIMENTS

Figure 1:
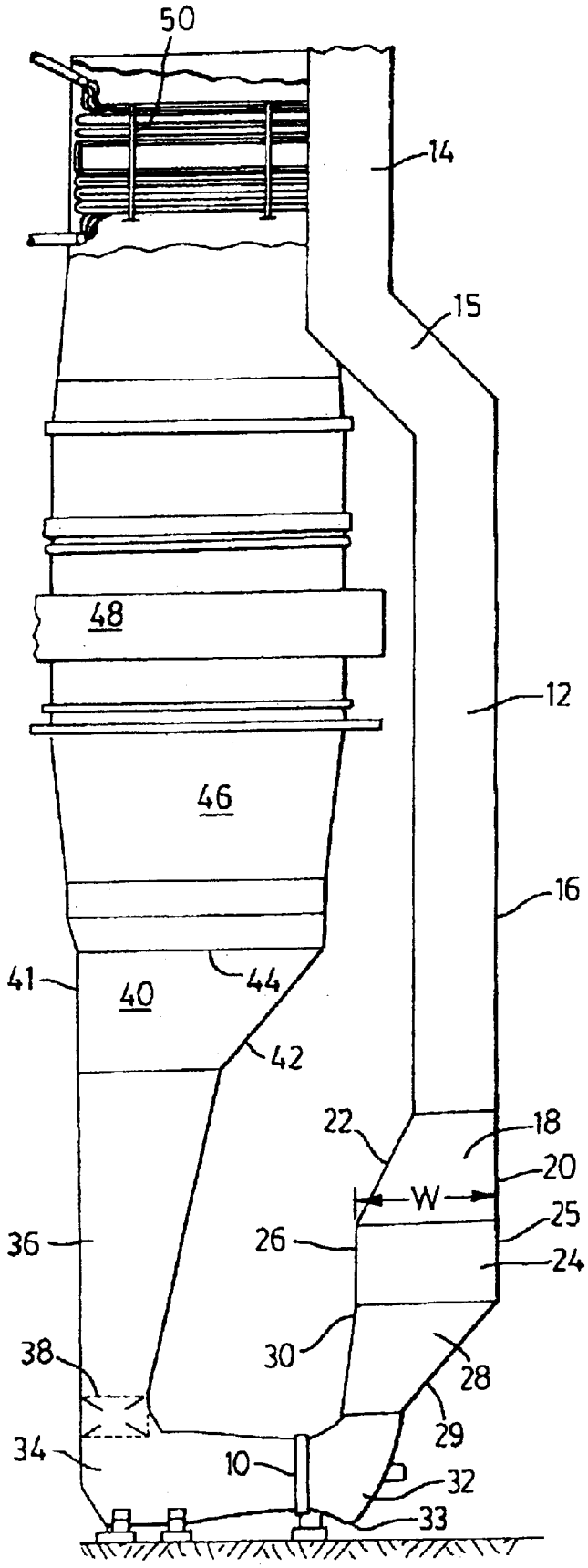
FIG. 1 (PRIOR ART)
FIG. 1 is a side elevation for a prior art system for delivering combustion air to a large utility or industrial boiler or steam generator, this view including a long duct section for delivery of air to a forced draft fan and a duct section connecting the fan unit to a bottom end of the boiler.

FIG. 1 illustrates a known system for delivering combustion air to a boiler unit by means of a standard forced draft fan located at 10. Fresh outside air is drawn into the inlet end of the fan 10 by means of a long, generally vertical inlet duct 12. As illustrated, this inlet duct has a straight upper section 14, a short sloping section 15 and a long, vertical intermediate section 16 that extends down to a transition section 18. The transition section has a vertical side wall at 20 and a downwardly and outwardly sloping side wall at 22. The transition section 18 widens the air passageway substantially to a width W which in one embodiment is about 13 feet. Connected to the bottom of the transition section is a known, splitter silencer unit indicated generally at 24 and explained in more detail hereinafter with reference to FIGS. 2 and 6. The splitter silencer has four vertical exterior sides, including opposing sides 25 and 26. Located below the silencer unit is another transition section 28 which has inwardly and downwardly tapering side walls 29 and 30. Located below the transition section is a trap section 32 which forms an almost 90 degrees elbow for turning the air flow through a substantial angle so that the air flow becomes generally horizontal as it enters the fan unit 10. The trap section 32 has a low level region 33 which collects any water that might come down the inlet duct 12 so that it can be drained out and will not enter the fan 10.

Connected to the outlet side of the fan unit 10 is an elbow section of duct 34 wherein the pressurized airflow from the fan turns a sharp 90 degrees and becomes an upwards flow through an elongate connecting duct 36. The duct section 36 increases in width as shown from a bottom end located at 38 to a transition section 40. The transition section 40 includes a vertical wall 41 and an outwardly and upwardly sloping wall 42 and it is substantially wider at its upper end 44 compared to its bottom end. The transition section connects the connecting duct 36 to an open bottom of the boiler unit indicated generally at 46. This boiler unit includes a standard steam coil air heater 48 (SCAH) and can also include a regenerative air heater (RAH) of known construction. There can also be an economizer 50 located at the top of the boiler unit. The boiler unit, of course, includes a number of coils which can be used to produce steam, these coils and the water therein heated by hot air from combustion at the air heaters.

The present invention is directed to improved sound attenuating duct units to replace the inlet duct 12 and splitter silencer 24 illustrated in FIG. 1 and also to an improved outlet duct apparatus for connecting the outlet of the air supply fan 10 to an air heater unit such as that found in the standard boiler unit 46.

Figure 2:
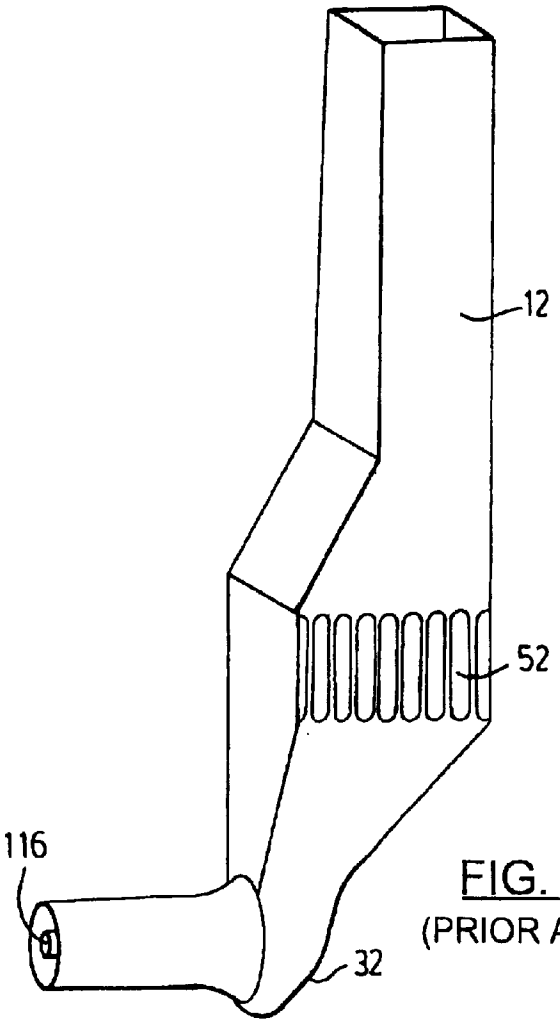
FIG. 2 (PRIOR ART)
FIG. 2 is a schematic perspective view of a prior art sound attenuating duct unit.

With reference to FIG. 2, this figure illustrates schematically the sound attenuating duct unit in the system of FIG. 1 and, in particular, the splitter silencer. The splitter silencer has a plurality of standard, generally flat air stream splitters 52 each of which contains a standard form of sound attenuating material such as fiberglass bats or mineral wool. The flat, vertical sides of each splitter are formed of perforated sheet metal in the well known manner and the vertical length of each splitter is the same. The top ends of the splitters are aligned in a horizontal plane and the same is true of the bottom ends. A splitter silencer of this type typically has an open area as seen in horizontal cross-section of between 45 and 55 percent. Since the incoming airflow follows the path of least resistance, the flow across the splitters 52 is not uniform and there is a biased flow in the center of this silencer unit 24. This results in a change in the face velocity which is directly proportional to the pressure drop across the splitters. There is also a sudden change in the flow velocity, particularly in the region of trap section 32 which may cause flow induced vibrations.

Turning now to a first embodiment of sound attenuating duct unit for delivery of air or gases to an inlet of the fan unit, this duct unit being constructed in accordance with the invention, reference will be made to FIGS. 3 to 5, 7 and 8. This duct unit indicated generally at 55 includes an elongate duct 56 for transferring air or gases to the inlet of the fan. The duct 56 includes an elongate first duct section 58 for transferring air or gases from an inlet end 60 to an opposite end located at 62. As can be seen clearly in the schematic view of FIG. 8, this first duct section can have a rectangular horizontal cross-section formed by four exterior walls 64 to 67. If desired, two opposing walls of the duct or all four walls of the duct can be lined with sound attenuating material, this material being covered by perforated sheet metal in a manner known per se. The duct 56 also has a second duct section 68 having an upstream first end 70 connected to the end 62 of the first duct section and a downstream second end 72. The second duct section bends through a smooth curve between the first end 70 and the second end 72, the amount of this bending being substantially less than 90 degrees. The second duct section has an upper portion indicated at 74 that extends substantially vertically during use of this duct unit. Preferably the amount of bending of the second duct section is less than 45 degrees and, in the preferred illustrated embodiment, the amount of bending of the second duct section in fact does not exceed 30 degrees.

A single, elongate splitter 76 is rigidly mounted in the second duct section 68 and contains sound attenuating material 78. This sound attenuating material can extend substantially the entire length of the splitter between a first end 80 thereof and a second end 82. The preferred sound attenuating material comprises mineral wool which is wrapped in MYLAR™ sheeting which acts to prevent the mineral wool from being pulled from the interior of the splitter by the airflow in the duct unit. Instead of mineral wool, it is also possible to use fiberglass batting which can also be covered by protective sheeting if desired. Preferably, the sheet metal sides of the splitter 76 are made of perforated 16 gauge galvanized steel. This perforated sheet metal forms a first longitudinally extending side 84 which forms the inside of the bend in the splitter and a second longitudinal side 86 which forms the outside of the bend. A semi-cylindrical nose portion 88 of the splitter can be made of imperforate sheet metal and it can be reinforced and strengthened by means of an internal wall 90 extending from one side to the opposite side of the splitter. A smaller, semi-cylindrical nose section can be provided at the end 82 of the splitter. Like the second duct section 68, the splitter itself bends through a smooth curve between its first end 80 and its second or downstream end 82. In fact, the amount of bending of the splitter corresponds substantially to the bending in the second duct section 68. The splitter 76 extends lengthwise along at least a major portion of the second duct section 68 between the first end 80 and the second end 82 and it is located centrally in the second duct section so as to divide the airflow passageway of the duct unit into two, substantially equal, smaller passageways 92 and 94.

It should be understood that in the preferred embodiment of the duct unit 55, the first duct section 58 is in fact substantially longer than the second duct section 68 and extends substantially vertically during use of the duct unit. For ease of illustration, only a portion of the first duct section 58 is shown in FIGS. 3 to 5, 7 and 8. In fact, the first duct section 58 can be as long as the duct sections 14, 15 and 16 of the prior art duct illustrated in FIG. 1 and, as in FIG. 1, the first duct section 58 can include angular or curved bends, if desired.

Figure 4:
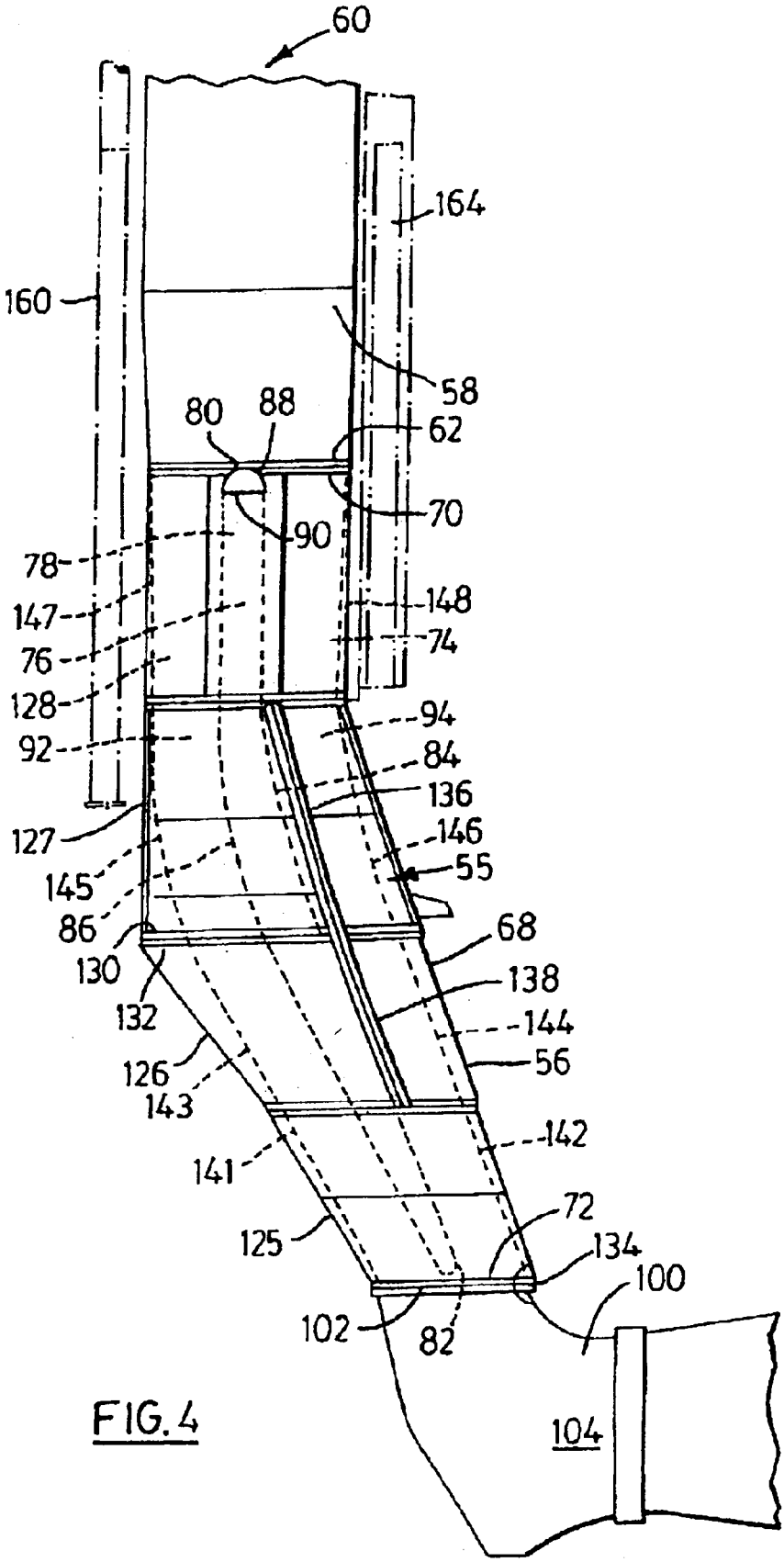
FIG. 4 is a side elevation of a first embodiment of sound attenuating duct unit constructed according to the invention.
Figure 5:
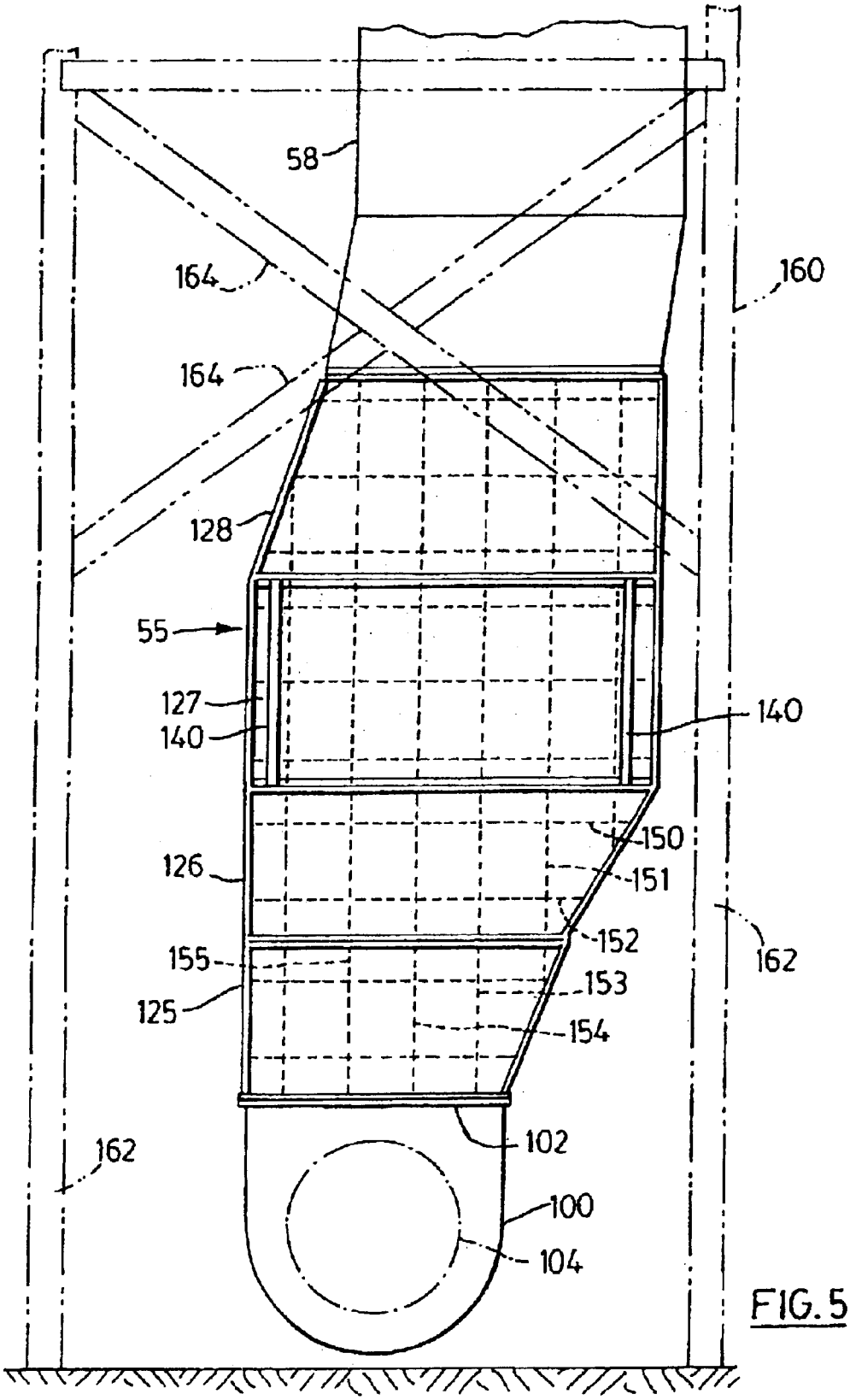
FIG. 5 is a front elevation of the sound attenuating duct unit of FIG. 4.

The duct unit 55 also includes a third duct section 100 having a top end which is connected to the second end 72 of the second duct section 68 during use of this duct unit. The duct section 100 of FIGS. 4 and 5 is similar in its construction to the prior art trap section 32 illustrated in FIG. 1. The duct section 100 includes a short horizontal portion 104 connected to the inlet side of the air supply fan. The third duct section 100 during use thereof causes a substantial change in direction of the flow of the air or gases flowing through the duct unit 55, this change in direction of flow being less than 90 degrees.

Figure 8:
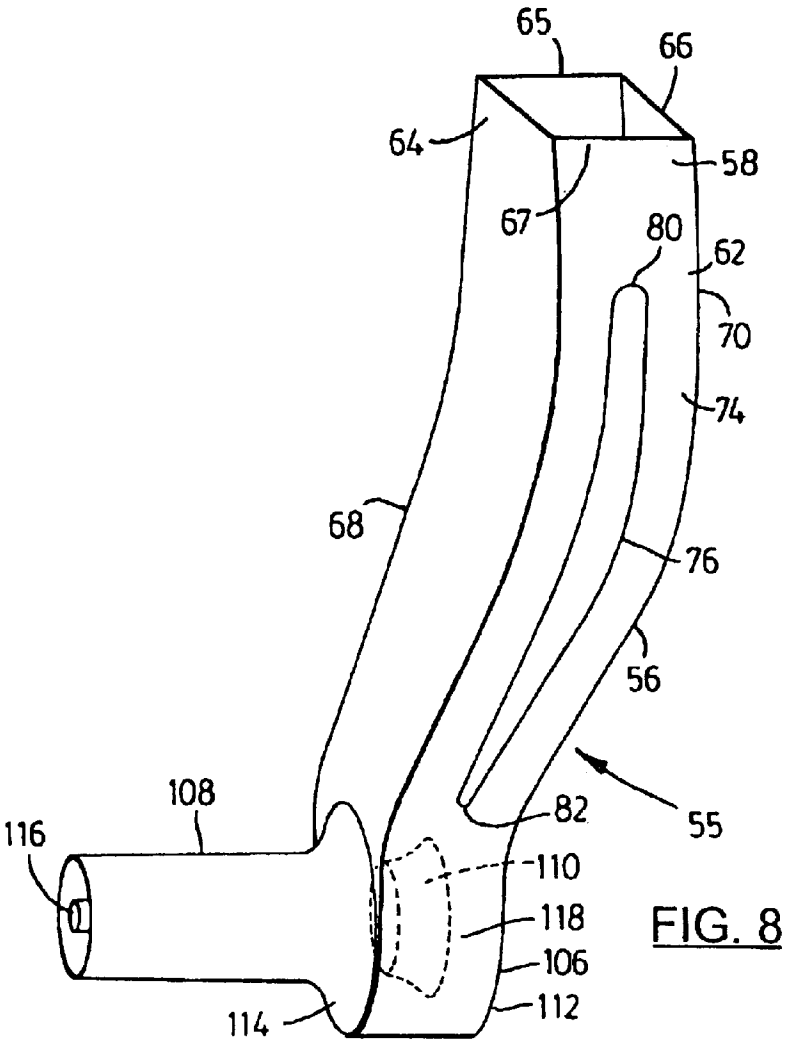
FIG. 8 is a schematic perspective view similar to that of FIG. 2 but illustrating the sound attenuating duct unit of the invention.
Figure 3:
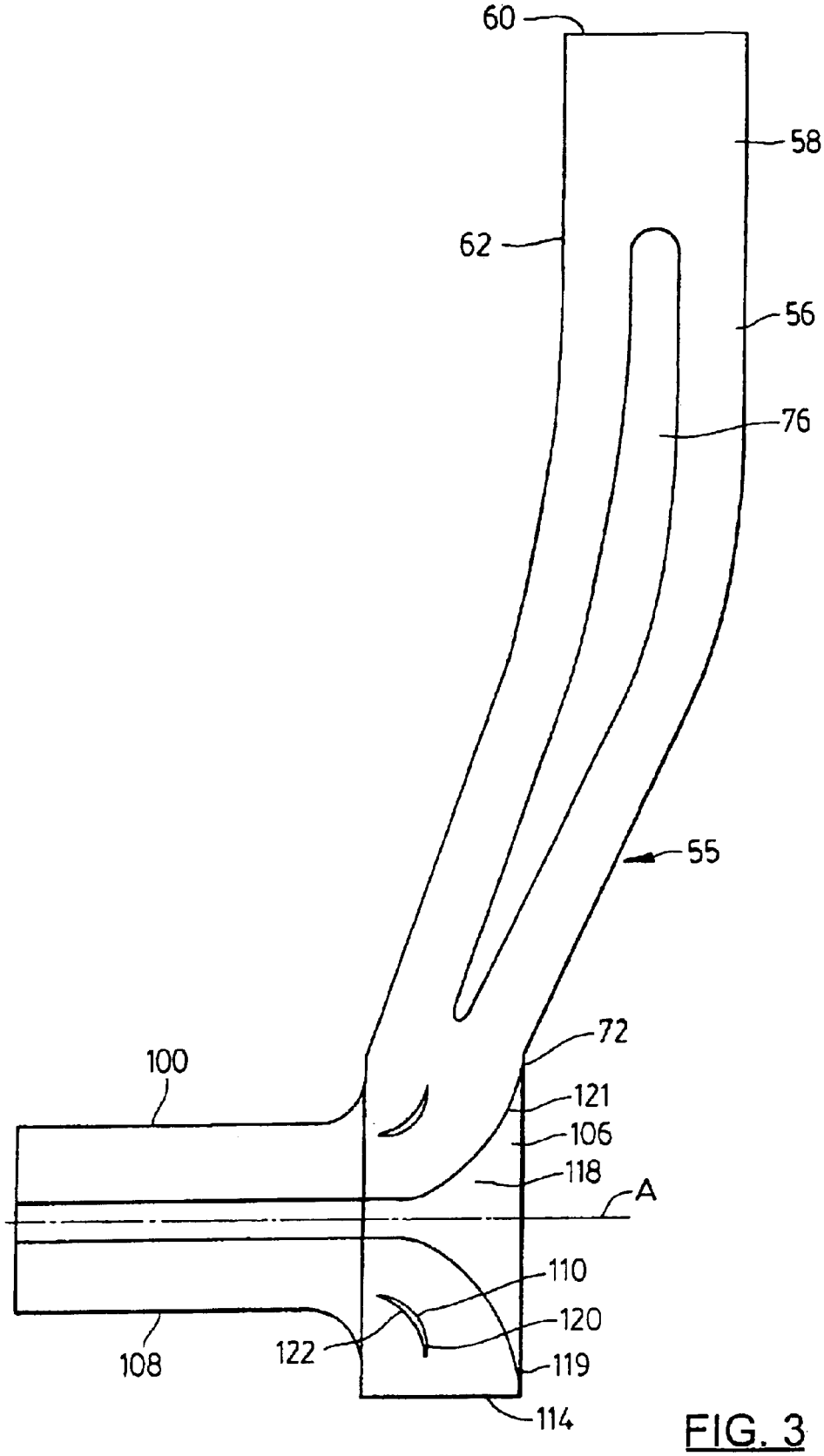
FIG. 3 is a schematic vertical cross-section of a duct unit constructed in accordance with the invention.
Figure 7:
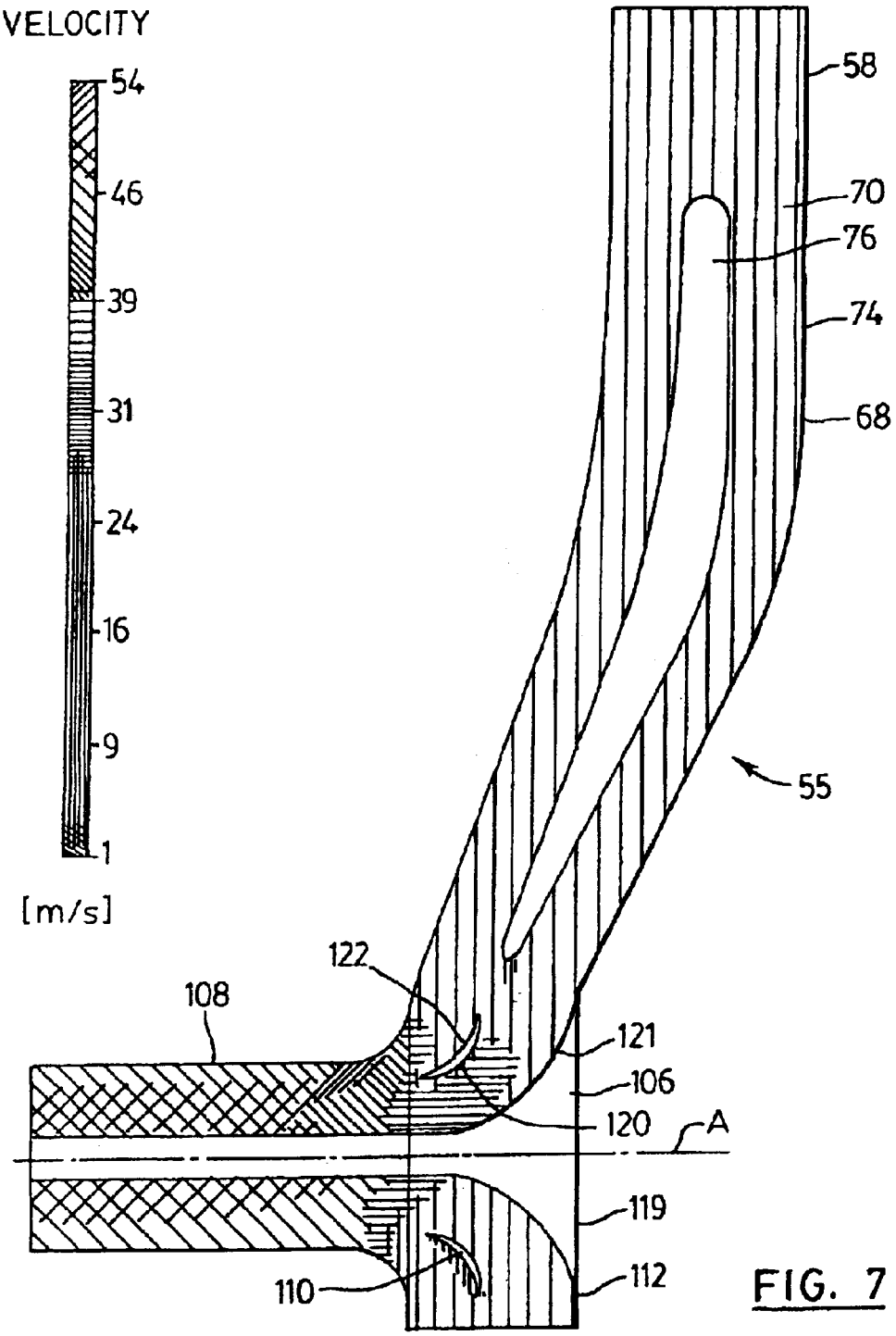
FIG. 7 is a schematic side elevation similar to FIG. 6 but illustrating the velocity of air flow at various locations in a sound attenuating duct unit of the invention, this duct unit corresponding to that illustrated in FIG. 3.

An alternate, preferred form of third duct section is indicated at 106 in FIGS. 3, 7 and 8 This duct section 106 also has a horizontal portion 108 adapted for connection to the inlet side of the air supply fan. In this preferred third duct section, there is an annular intake baffle 110 which is fixedly mounted in the duct section by means of suitable support struts (not shown) that are arranged and distributed so as not to interfere with the air flow through the duct section. These support struts can be cross bars (for example, ¼"×4" flat bars) spaced at 90 degrees apart. These cross bars attach the baffle 110 to the walls of the elbow section 106. The baffle extends about a central axis indicated at A of the horizontally extending portion 108, which axis is normally coaxial with that of the fan unit. The baffle is spaced radially away from the axis A. The intake baffle may contain sound attenuating material such as the aforementioned mineral wool (or fiberglass batting) which is wrapped in and protected by MYLAR™ sheeting. It will also be understood that the intake baffle 110 is located in a trap portion 112 of the third duct section 106, this trap portion being arranged between and connected to the second duct section 68 and the horizontal portion 108 during use of the duct unit. As indicated above, the purpose of the trap portion 112 is to collect any water that might come down the duct unit 55 so that it can be drained out (by a drain, not illustrated). It should be noted here that although the horizontal portion 108 is illustrated as being somewhat elongate in FIGS. 3, 7 and 8, which are schematic, the horizontal portion can in fact be quite short, for example, similar to the short horizontal portion used with the prior art trap of FIG. 1.

The preferred trap portion 112 has a rounded, semi-cylindrical bottom 114 (see FIG. 8), this bottom extending below the horizontal portion 108 during use of the duct unit. The horizontal extending portion 108 can be cylindrical in shape and open ended and it will be seen that a drive shaft 116 for the fan can extend along the central axis of this horizontal portion (as in the prior art—see FIG. 2). It will be understood that this drive shaft can also extend through the trap portion 112 to an electrical drive motor (not shown) located outside of the duct unit. The hole through which the drive shaft extends in the side of the trap portion is suitably sealed in a known manner. The preferred trap portion 112 has opposed vertical side walls 118 that are spaced apart a distance greater than the internal diameter of the horizontal portion 108 and an end or back wall 119. Fixedly mounted on the back wall 119 is an interior, air directing cone 121 formed of imperforate sheet metal. This cone has an opening at its apex for passage of the drive shaft for the FD fan.

Returning to the intake baffle 110 which is preferably provided, this baffle preferably converges inwardly in the direction of flow of the air or gases as illustrated in FIGS. 7 and 8 and it is preferably formed of perforated sheet metal such as 16 gauge galvanized steel on both sides if it contains sound attenuating material. The illustrated preferred baffle has a convexly curved inner surface 120 and a radially outer surface 122 which is concave. It will be appreciated that with the combination of a single, elongate splitter 76, the annular intake baffle 110, and the interior cone 121, a streamline airflow is provided and there is more open area for the air to flow through the duct unit into the fan. This streamlining of the airflow and the controlled velocity of the airflow eliminates flow induced vibrations and eddies in the air flow. This in turn results in minimal noise coming from the duct unit. Furthermore, the preferred duct unit 55 of the invention offers uniform loading of air to the fan blades for better fan performance. It is believed that the preferred duct unit of the invention can provide pressure drop savings in the range of 1–1.5 inches WG and the noise attenuation provided can be up to 5 dB better than the noise attenuation provided by the conventional, prior art duct units.

It will be seen that in the preferred embodiments of the duct unit, the amount of bending of both the second duct section 68 and the splitter 76 is less than 45 degrees and, more preferably, the amount of bending does not exceed 30 degrees.

Turning now to the preferred construction details of the duct unit 55 as illustrated in FIGS. 4 and 5, it will be seen that the second duct section 68 can be made from four, separate duct components 125 to 128 with the duct component 128 at the top and the duct component 125 at the bottom end. These components can be, made as separate, manageable units in the factory and then transported separately by truck or train to the installation site where they are connected together, top to bottom. The long splitter 76 can also be split into four parts, one for each of the duct components 125 to 128 and these parts can be mounted in their respective components at the factory and they are connected together when the duct components 125 to 128 are connected. The duct components 125 to 128 can be connected together by bolts and nuts using connecting flanges such as adjacent flanges 130 and 132. In order to allow for thermal expansion of the overall duct unit, an expansion joint 134 of standard construction can be provided between the duct component 125 and the third duct section 100 or 106. The external walls of the duct unit 55 can be fabricated from one quarter inch A-36 carbon steel plate which can be stiffened on at least two sides by means of three inch by three inch by one quarter inch angle members such as the angle members 136, 138 and 140 shown in FIGS. 4 and 5.

Each of the duct components 125 to 128 is also preferably provided with opposed, perforated interior walls indicated at 141 to 148 in FIG. 4. Depending upon the amount of sound attenuation required for the particular duct unit, these interior walls can be provided on just two opposing sides of each duct component as shown in FIG. 4 or on all four sides of each duct component and sound attenuating material is provided behind each of these interior walls. Only the interior walls 141 to 148 beside the center body or splitter 76 are lined with the acoustic material which preferably is a minimum 4 inches in thickness. In the illustrated embodiment of the duct unit, two opposing interior walls are made of 16 gauge galvanized steel perforated with numerous small holes distributed over the surface of the sheet metal in a manner known per se. As in the splitter 76, the sound attenuating material can either be fiberglass batting, for example, ¾ pound fiberglass, or mineral wool, and a MYLAR™ film is arranged between the perforated sheet metal and the sound attenuating material to prevent erosion of the sound attenuating material due to the air flow through the duct unit. The grid of criss-crossing horizontal and vertical dashed lines such as the lines 150 to 155 indicated in FIG. 5 illustrate the typical supporting structural members on the outside of the exterior walls. Also, an interior support structure which connects the interior and external walls can be provided by criss-crossing 12 gauge formed channels that are joined by welding (for example) to the sheet metal panels. These channels are placed a maximum of two feet apart. This interior structure can also help to hold the sound attenuating material in place.

Also illustrated in dot dashed lines in FIGS. 4 and 5 is a supporting framework 160 rigidly supporting the duct unit in a generally vertical position. With reference to FIG. 5, there can be two to four steel support posts 162 that are firmly mounted in the ground or in a concrete base (not shown). These posts can, for example, be made of interconnected steel angle members or they can be steel tubes, if desired. Each pair of posts 162 can be rigidly connected to one another by means of crossing steel connectors 164, the ends of which can be welded to the posts. In one embodiment, each connector 164 is formed from two 8"×6"×7/16" angle members connected to each other by means of bolts or welding. It will be appreciated that the other duct units of the invention described herein can be supported by a structural steel framework similar to the frame work 160. Suitable connectors, such as steel brackets, can be used to join the steel exterior of the duct unit to the framework 160.

In order that there will be no gaps or leaks between the duct components 125 to 128, a 1/8th inch neoprene gasket, which forms an air tight seal, can be arranged between the connecting flanges. In one preferred embodiment, these connecting flanges are formed by 3"×3"×1/4" angle members.

Figure 9:
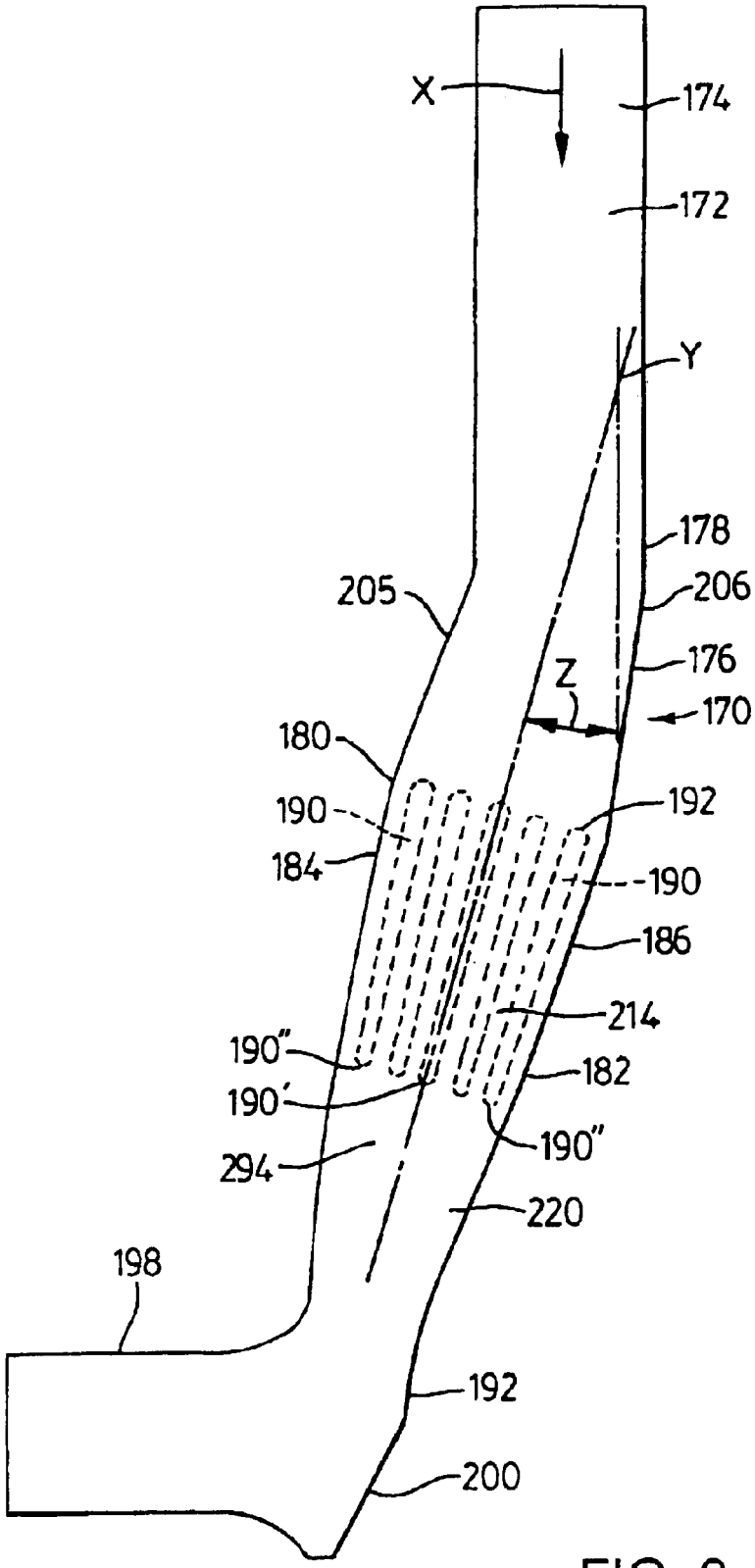
FIG. 9 is a schematic side elevation of another embodiment of sound attenuating duct unit constructed in accordance with the invention.
Figure 11:
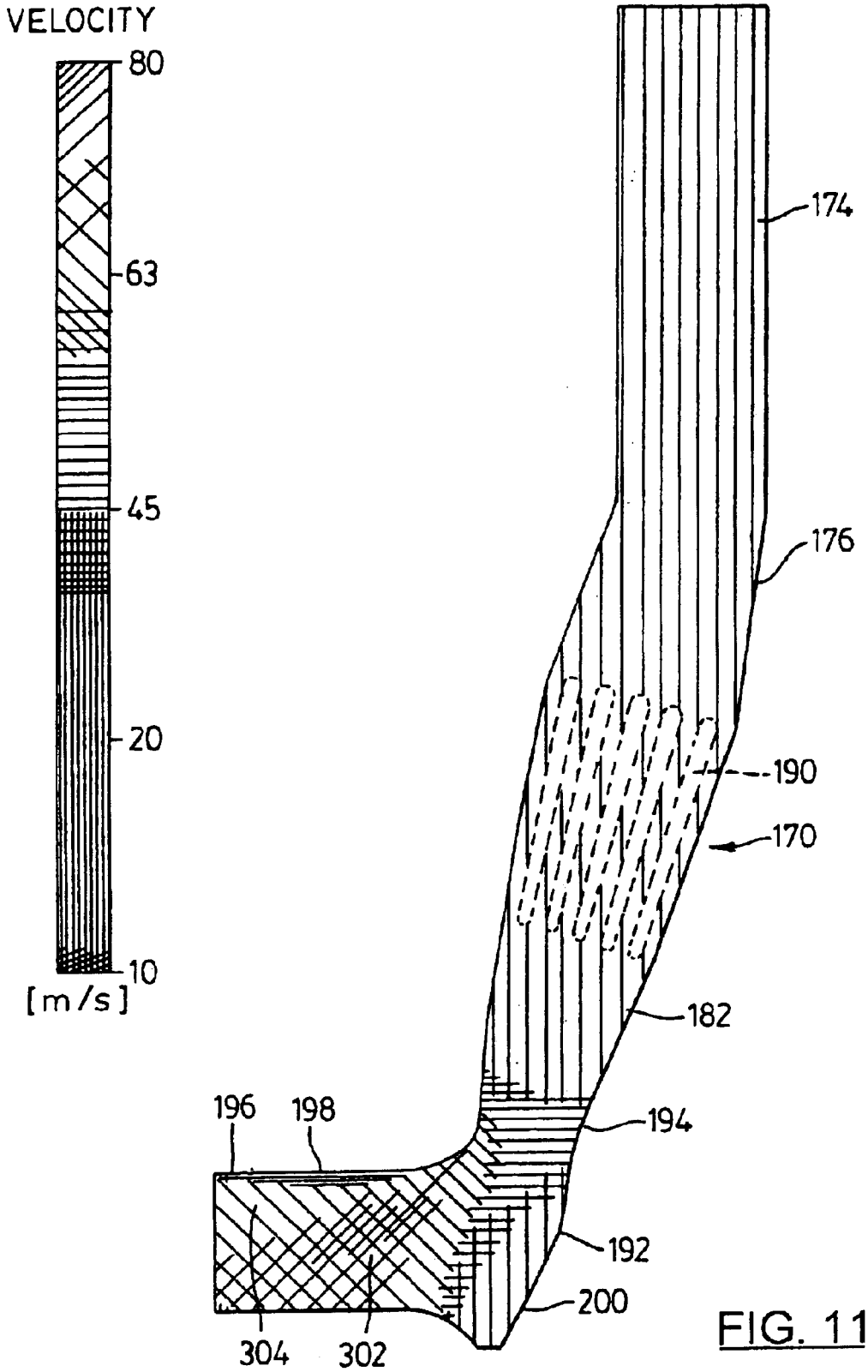
FIG. 11 is a schematic side elevation similar to FIG. 10 but illustrating the velocity of air flow at various locations in the second embodiment of a sound attenuating duct unit of the invention.
Figure 12:
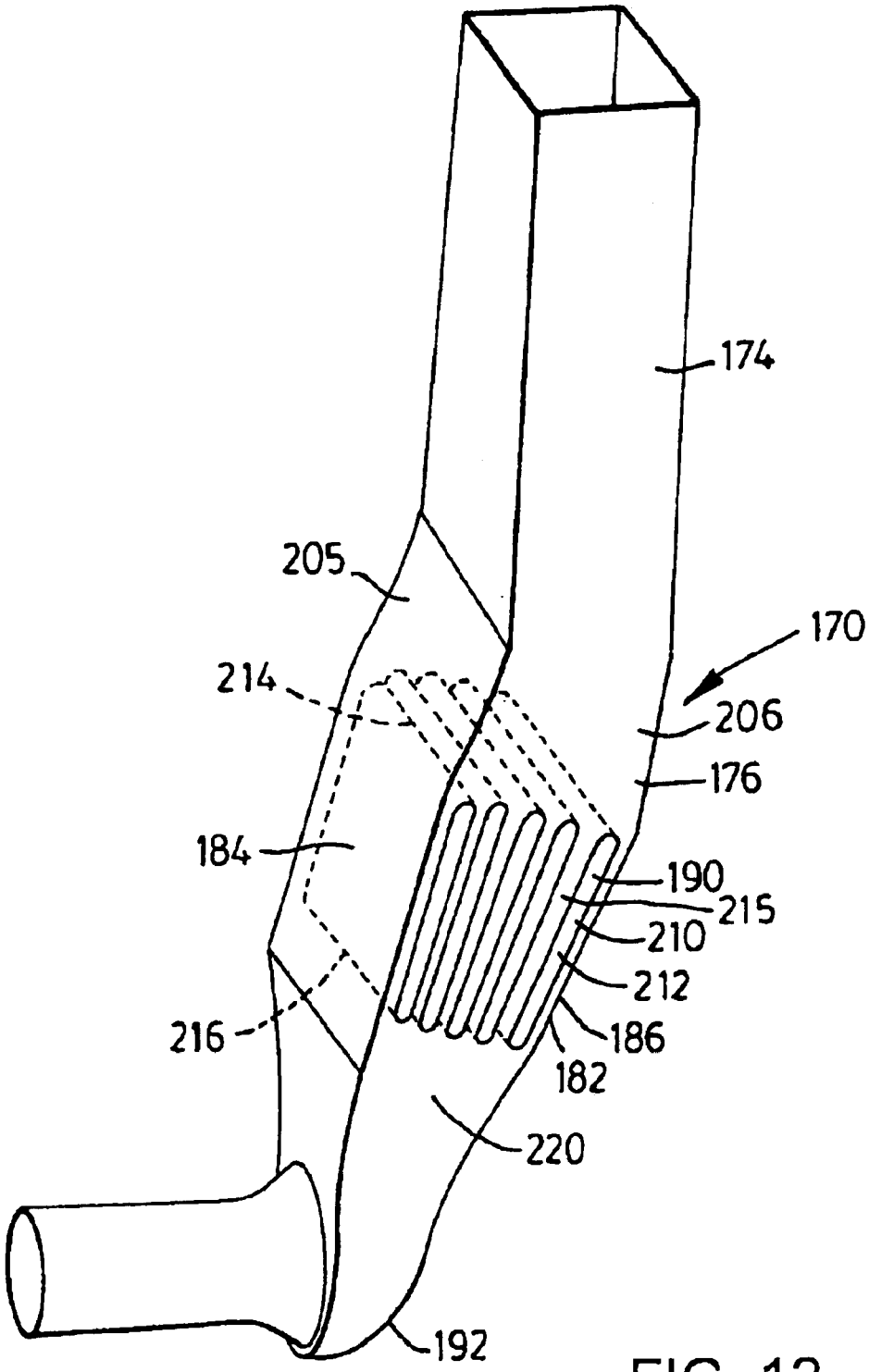
FIG. 12 is a schematic perspective view of the sound attenuating duct unit of FIGS. 9 and 11.

Turning now to a second version of sound attenuating duct unit for delivery of air or gases to an inlet of a fan unit, this second embodiment is illustrated schematically in FIGS. 9, 11 and 12 and is indicated generally by reference 170. The duct unit 170 comprises an elongate duct for transferring air or gases to the inlet of a fan unit such as the fan 10 of FIG. 1. It will be understood that this duct unit is intended to replace and to improve upon the duct unit 12 shown in FIG. 1. As in the first embodiment of the invention, the duct has exterior walls 172 which normally comprise four walls that form a duct having a rectangular or square transverse cross-section. As in the first embodiment, the exterior walls of this duct unit can be made from 1/4 A36 carbon steel plate. The illustrated, preferred duct has a relatively narrow first section 174, a second, transition-type expanding section 176 having one end indicated at 178 that is connected to an adjacent end of the first section and an opposite second end 180. The duct further includes a tapered sound attenuating third section 182 that is connected to the second end 180 of the second section. As illustrated, the elongate duct is adapted to extend substantially vertically with the first section 174 on top and the third section at a bottom end thereof. The third section also has four side walls including two opposite first and second walls 184 and 186 that taper towards each other in the direction of air or gas flow through the elongate duct. This direction of air flow is indicated by the arrow X in FIG. 9. It will also be understood that the first section 174 can be substantially longer than the section illustrated in FIGS. 9 and 11 and can, for example, be similar in length to the duct sections 14, 15 and 16 shown in FIG. 1.

Third section 182 has mounted therein a plurality of spaced-apart splitter members 190, each containing sound attenuating material. As in the first embodiment, the sound attenuating material can be mineral wool or fiberglass batts, preferably wrapped in or covered by MYLAR™. As in the splitter of the first embodiment, the flat, opposite side walls of each splitter are made of perforated sheet metal which can be 16 gauge galvanized steel. The semi-cylindrical upper end 192 of each splitter can be made of imperforate 16 gauge galvanized steel. It will be understood that each of these splitters 190 extends from one side wall of the duct to the opposite side wall and they can be held in position by bolts and nuts and connecting flanges or brackets or by welding. The splitters 190 are substantially planar but are elongate in the direction of air or gas flow through the third section. The splitters 190 include at least one central splitter 190' and outer splitters 190" with the outer splitters converging inwardly towards a central longitudinal axis of the third section 182 from their upstream ends to their downstream ends.

This second embodiment of a duct unit constructed in accordance with the invention also includes an elbow-shaped duct section 192 having an upstream end 194 connected to the third section 182 and a downstream end 196 for connection to an air supply fan unit such as the fan unit 10 shown in FIG. 1. As in the embodiment of FIGS. 4 and 5, the duct section 192 includes a horizontally extending duct portion 198 which can be cylindrical in shape and which can be connected to the air supply fan unit and an enlarged end portion 200 that extends below the duct portion 198 and that has a top at 194 connected to the third section 182. As in the duct unit shown in FIG. 1, the enlarged end portion 200 can form a trap section and a rotatable drive shaft for the fan unit can extend through this end portion and through the horizontal duct portion 198. It will be appreciated that the trap section of the duct unit 170 can also be shaped and constructed in the manner illustrated in FIGS. 7 and 8 and it can contain, if desired, the above described intake baffle 110 in order to improve the air flow characteristics and sound attenuating characteristics of this second embodiment.

FIG. 9 illustrates by the dash line Y the central longitudinal axis of the third section 182 and it will be seen that this axis extends at an acute angle Z to a vertical axis intersecting this central longitudinal axis. In one preferred embodiment, this acute angle at which the longitudinal axis extends is less than 25 degrees.

The second expanding section 176 has two opposite side walls 205 and 206 that diverge from each other in the direction of air or gas flow through this section. The side walls 205, 206 are respectively connected at their second or bottom end to the first and second side walls 184, 186 of the third section of the duct and it will be seen that there is only a small, angular bend at this junction. Also, in this preferred embodiment, the opposite side walls 205 and 206 of the second section extend at an acute angle, preferably a small acute angle, to a vertical plane during use of this duct unit. Thus, the direction of airflow bends only slightly between the first section 174 and the expanding section 176. The angle of expansion in the section 176 is also relatively small compared to the prior art duct.

It will also be seen that the opposite side wall 210 and 212 of each splitter converge towards one another in the direction of air or gas flow. This convergence of the splitters is sufficient to accommodate the convergence of the side walls 184 and 186 of the third section of the duct. The relatively narrow, air passageways 215 formed between adjacent splitters can be of substantial uniform width from their inlets to their outlets but this is not essential. The width of these passageways is determined on the basis of sound attenuation requirements and so as to provide a smooth, non-turbulent airflow across the intake system.

As indicated by the dashed lines 214 and 216 in FIG. 12, each of the splitters 190 extend substantially across the width of the third section 182 and they are rigidly connected at their opposite sides to the walls of the third section. Preferably the splitters 190 are arranged in a side-by-side manner in the third section with their upper ends aligned and their bottom ends aligned in the transverse direction. Although the illustrated sound attenuating duct unit is shown with five splitters 190, there can be more than five or less than five splitters, if desired. Generally speaking, fewer splitters rather than more splitters are desirable so as to provide more open area between the splitters for the air flow.

The preferred illustrated third section 182 includes a hollow transition region 220 located downstream of the splitters 190. In this region, the opposite side walls of the duct can converge at a greater rate towards one another, as clearly visible in FIG. 12. The two opposite side walls 184 and 186 of the third section extend along the length of the splitters and then they bend slightly inwardly to extend along the length of the transition region 220. In the transition region 220, the internal cross-section of the duct is reduced gradually and smoothly until this region merges with the duct section 192

It will be appreciated by those skilled in the art that the second embodiment of the duct unit of the invention illustrated in FIGS. 11 and 12 can also be made with perforated interior walls in a manner similar to the first embodiment illustrated in FIGS. 4 and 5 and that sound attenuating material can be placed between these interior walls and the exterior walls of the duct unit. Again, depending on the amount of sound attenuating required, the sound attenuating material can extend along only two opposing walls, for example, along the first wall 184 and the opposing second wall 186, or it can extend along all four walls of the duct unit. The internally lined walls of the duct can also extend along the duct only in the region of the splitters 190 or, if desired, internally lined duct walls can extend a substantial distance up the duct from the splitters and also downstream from the bottom ends of the splitters 190.

Figure 14:
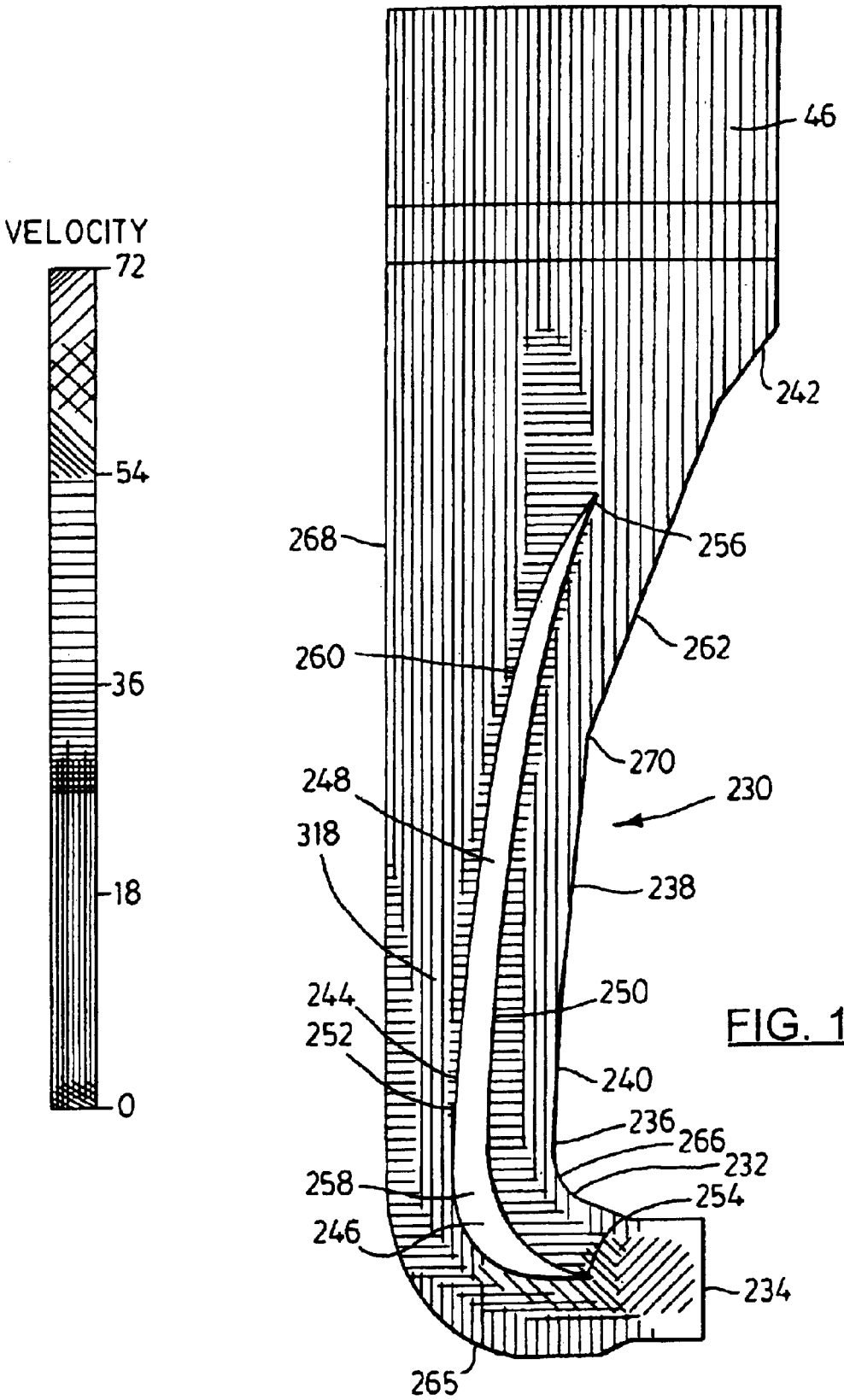
FIG. 14 is a schematic side elevation of a preferred embodiment of connecting duct unit constructed in accordance with the invention, this view being similar to FIG. 13 and showing the velocity distribution by the same type of hatching.
Figure 16:
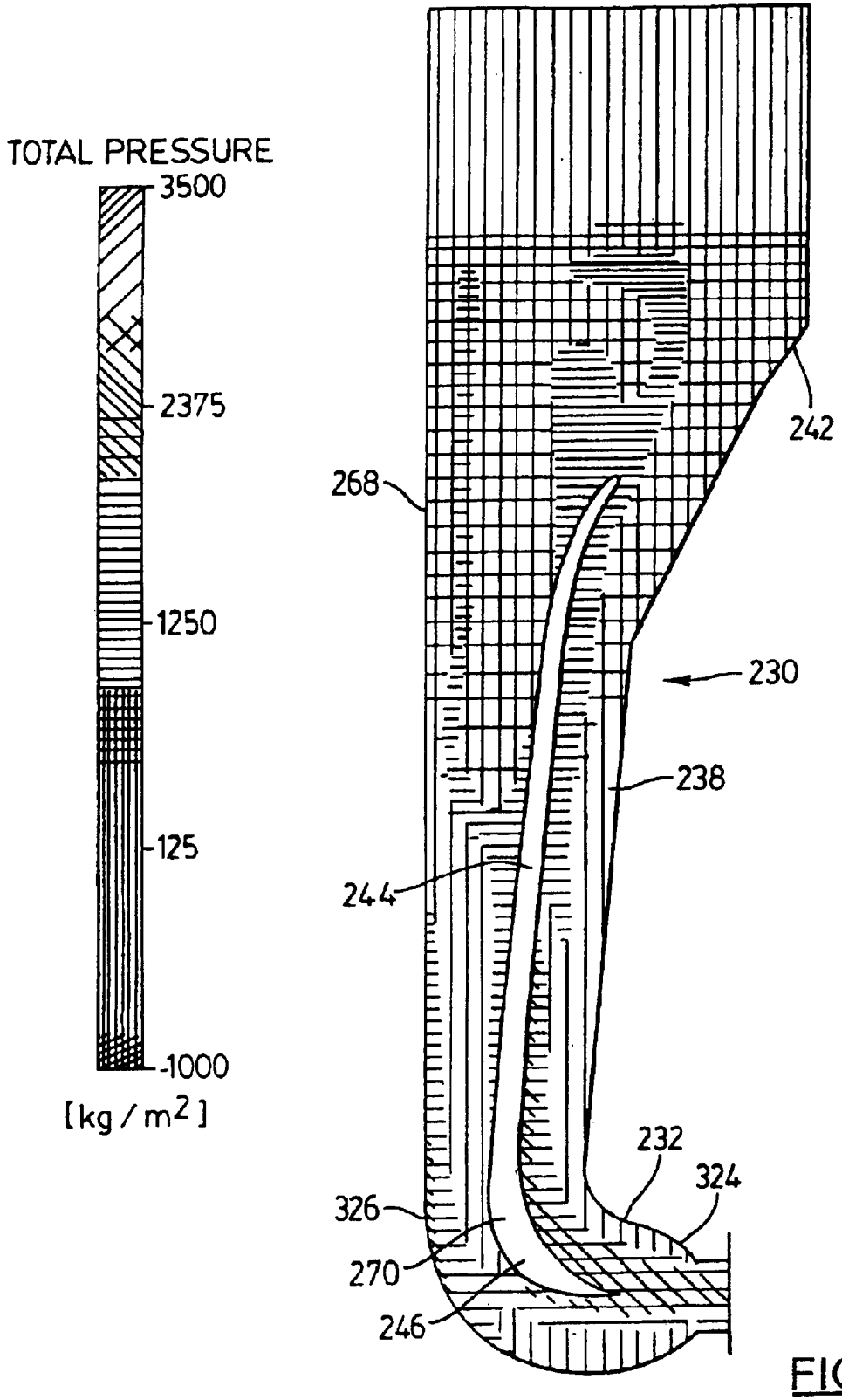
FIG. 16 is a schematic illustration similar to FIG. 15 but showing the total pressure distribution in the preferred connecting duct unit for a forced draft fan constructed in accordance with the invention.

Turning now to an outlet duct apparatus 230 constructed in accordance with the invention and illustrated schematically in FIGS. 14 and 16, this apparatus 230 can be used to connect an outlet of the air supply fan 10 to an air heater unit, such as an air heater unit in a large boiler. This outlet duct apparatus 230 can be used in place of the elbow section 34 and connecting duct 36 shown in FIG. 1. The apparatus 230 includes an elbow section 232 for transferring air from an inlet end 234 connectible to the air supply fan unit 10 to an opposite end thereof. As illustrated, this elbow section bends through a smooth curve between its inlet end 234 and the opposite end located approximately at 236. The amount of this bending is more than 60 degrees and, in the illustrated preferred embodiment, is about 90 degrees. The duct apparatus also has an elongate second section of duct 238 having an upstream first end located at about 240 connected to the adjacent end 236 of the elbow section and having a downstream second end 242 which is substantially wider than the first end 236 and is connectible to the air heater unit of the boiler unit 46. As the air heater unit and the boiler unit can be of standard, known construction, a detailed description herein is deemed unnecessary. Thus, the outlet duct apparatus 230 is connectible to the air heater unit during use of the outlet duct apparatus for delivery of combustion air through a relatively large air inlet or opening for the air heater unit.

The duct apparatus 230 also has a turning vane 244 rigidly mounted in the outlet duct apparatus and preferably having a substantially curved first vane section 246 located centrally in the elbow section and an adjoining second vane section 248 extending substantially upwardly during use of the outlet duct apparatus. As illustrated, there is a smooth transition between the first vane section 246 and the second vane section 248 on both a front side 250 and a rear side 252 of the turning vane. It will be understood that the turning vane, like the aforementioned splitters, extends across the width of the air passageway formed by the outlet duct apparatus 230. In particular, it extends across the width of both the elbow section 232 and the second section 238. It is rigidly connected to the opposite side walls of these two sections. As mentioned above, the preferred elbow section, which is shown in the figures, bends through a curve of about 90 degrees and the preferred turning vane 244 also bends through a curve of about 90 degrees from a leading edge 254 of the turning vane to a trailing edge 256 thereof.

The preferred, illustrated turning vane varies gradually in thickness along its length from its narrow, horizontally extending leading edge 254 to a thicker curved region 258 that extends through a downstream portion of the elbow section of the duct and into an upstream portion of the second section of duct 238. The turning vane then continues upwardly to a tapering region 260 where front and rear sides of the vane converge towards each other up to the trailing edge 256. Preferably, the second vane section 248 bends slightly towards an inner side wall 262 of the duct from its bottom end to the trailing edge 256 of the turning vane.

Figure 17:
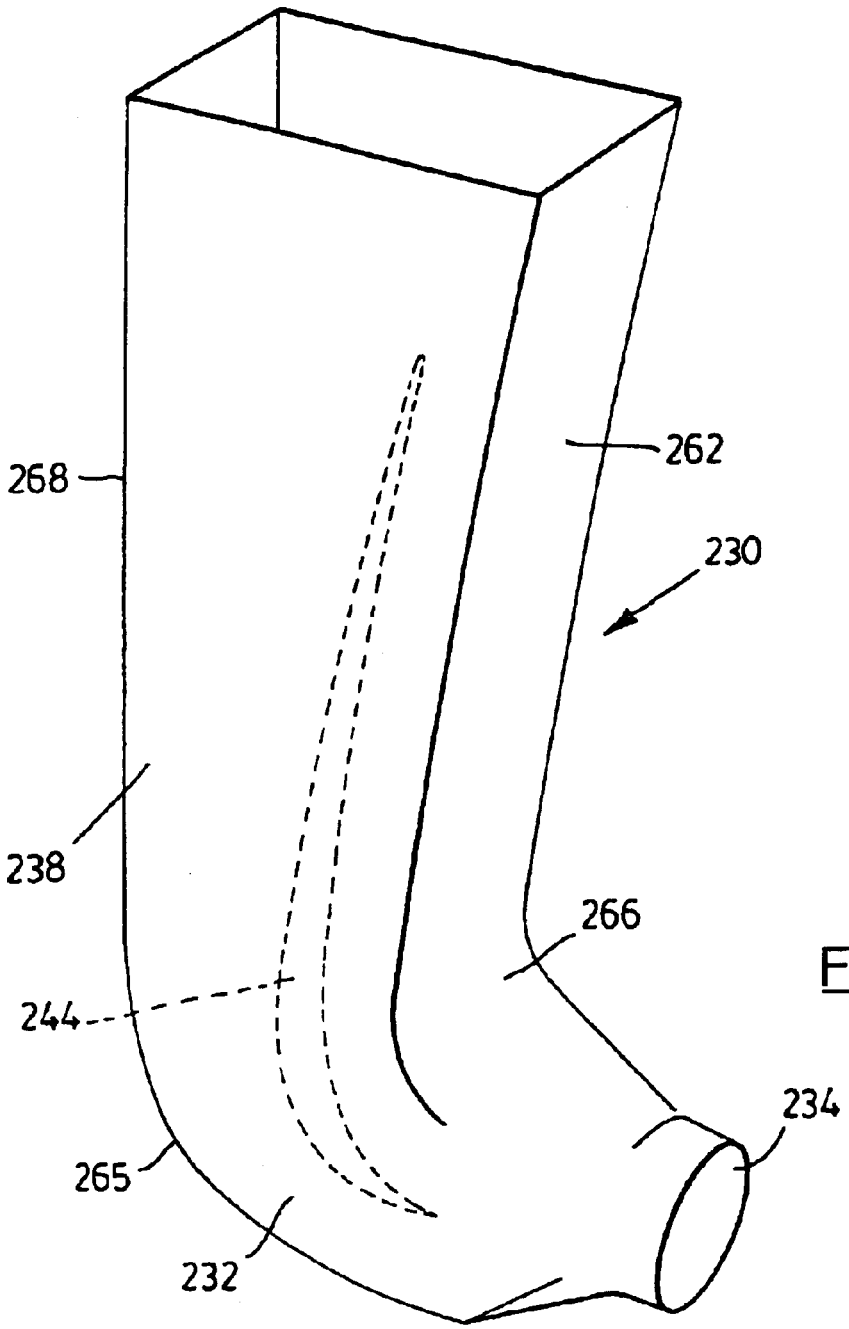
FIG. 17 is a schematic perspective view of a connecting duct unit similar to that shown in FIG. 16 and showing two vertical sides thereof.

Turning now to the preferred construction of the outlet duct itself, me elbow section 232 includes an outside curved sidewall 265 and an opposite inside curved sidewall 266 which can be seen clearly in FIG. 17. The second section 238 of the duct includes the aforementioned inner side wall 262 and an opposing outer side wall 268, both of which are straight or substantially straight. In the embodiment shown in FIG. 14 the inner side wall 262 has a slight bend at 270 but it still can be considered substantially straight. The inner side wall 262 is a smooth extension of the inside curved side wall 266 and the straight outer side wall 268 is a smooth extension of the curved side wall 265. The straight outer side wall 268 extends substantially in a vertical plane while the straight or substantially straight inner side wall 262 extends at a small acute angle to the vertical plane so as to diverge away from the straight outer side wall in an upwards direction.

Although the turning vane can be constructed as a hollow member containing no sound attenuating material, in a preferred version of the turning vane, the vane contains sound attenuating material indicated at 270. A suitable sound attenuation material is mineral wool but fiberglass batts are another possible material. Preferably the mineral wool is wrapped in or covered by MYLAR™ sheets. If the turning vane is to be made a sound attenuating member, then its front side 250 and its rear side 252 are made of perforated sheet metal which in one preferred embodiment is perforated 16 gauge galvanized steel. The MYLAR™ sheets are located between the mineral wool and the inside surface of the sheet metal.

In order to provide good sound attenuating characteristics in the outlet duct apparatus 230, both the elbow section 232 and the substantially straight section 238 are internally lined with sound attenuating material, ie. mineral wool, covered by perforated sheet metal interior walls. It will be appreciated that the walls of the outlet duct apparatus can be lined with sound attenuating material in a manner substantially similar to the lining of the duct unit 55 illustrated in FIGS. 4 and 5. With the outlet duct apparatus 230 of the invention, the user can obtain energy savings by virtue of converting velocity pressure to static pressure regain. With the prior art outlet duct apparatus of FIGS. 1, 13 and 15, the operation of the combustion air delivery system generates higher noise and turbulence. The outlet duct apparatus 230 is designed and constructed so as to reduce or avoid boundary layer separation and turbulence in the system. With the preferred apparatus 230, the end user can get pressure drop savings up to 3–4" W.G. and there is a substantial improvement in the flow pattern across the steam coil air heater.

Tests have been conducted in order to establish the advantages of the sound attenuating duct units and outlet duct apparatus of the invention as compared to the prior art sound attenuating duct units and outlet duct apparatus.

In the applicant's duct unit 55 the total pressure distribution in the horizontal portion 108 is generally more uniform than in the prior art duct unit This is a desirable condition as it will result in more uniform loading of air en the fan blades for better fan performance.

Figure 6:
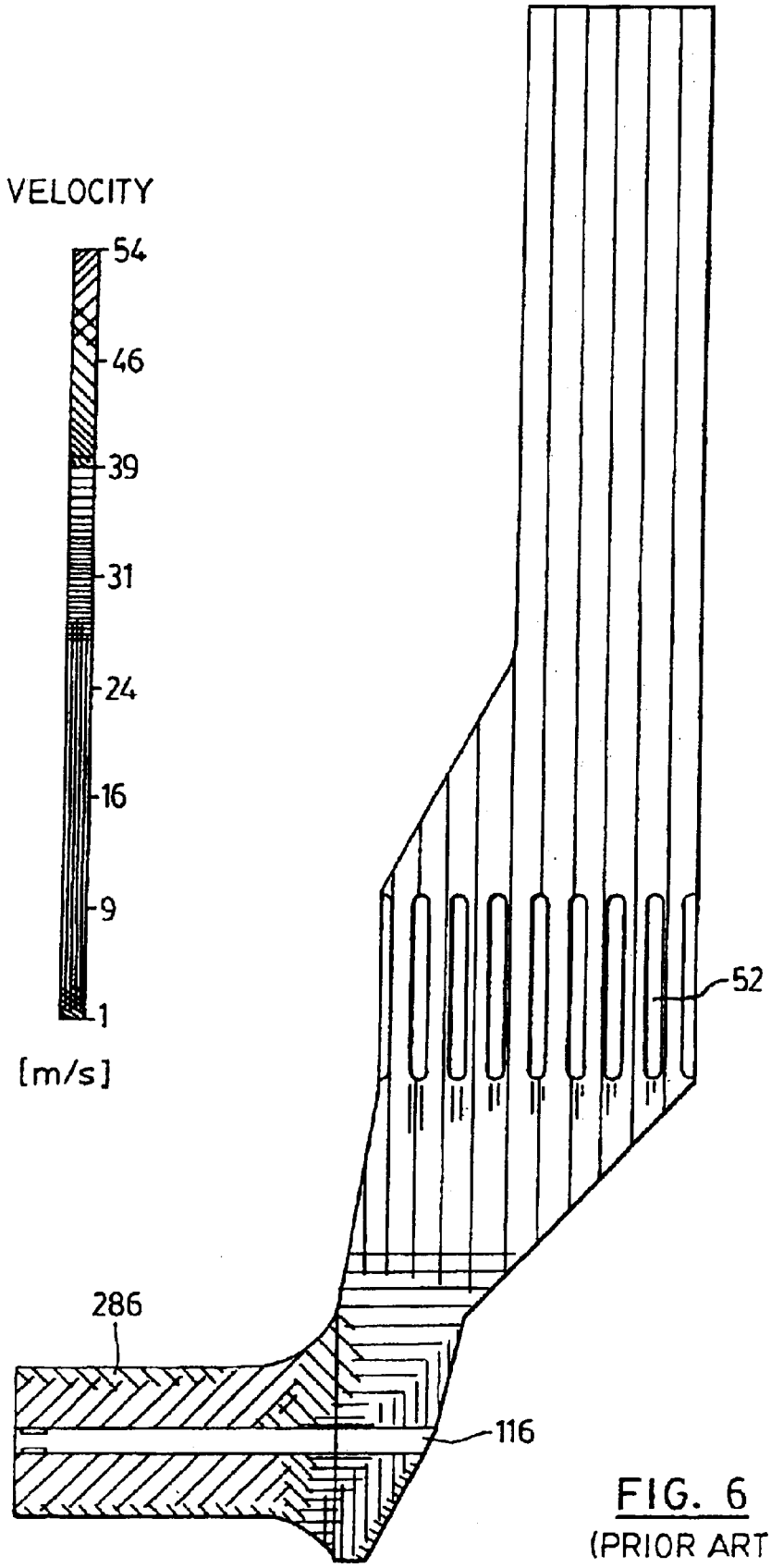
FIG. 6 (PRIOR ART)
FIG. 6 is a schematic side elevation of the prior art sound attenuating duct unit of FIG. 2, this view indicating the velocity of air flow by means of hatching at various locations in the duct unit.

Turning now to the velocity illustrations of FIGS. 6 and 7; a velocity scale from 1 to 54 m/s is illustrated on the left side of FIG. 6. Again, the hatching indicates that the velocity of the air flow is fairly low and uniform in the upper sections of both the prior art duct unit of FIG. 6 and the duct unit of the invention shown in FIG. 7 and also through the region of the splitters 52 or the single splitter 76. However, there is a substantial difference in the velocity readings in the horizontal portion that leads to the FD fan. In particular, there are much high velocity readings in the region 286, in the order of 54 m/s extending along the length of the horizontal portion, both below and above the drive shaft 116. However, in applicant's preferred duct unit shown in FIG. 7, the velocity readings in the portion 108 are generally lower, for example, in the range of 40–46 m/s. The more controlled velocity in applicant's duct unit helps to eliminate or reduce flow induced vibrations as well as eddies in the flow and this results in less noise being produced from the duct unit.

With applicant's duct unit 170 there is a more uniform pressure distribution in the transverse direction in the splitter region. With the improved duct unit 170 of the invention, it is possible to decrease the pressure drop in the range of 0.95 to 1.5 inches WG.

Figure 10:
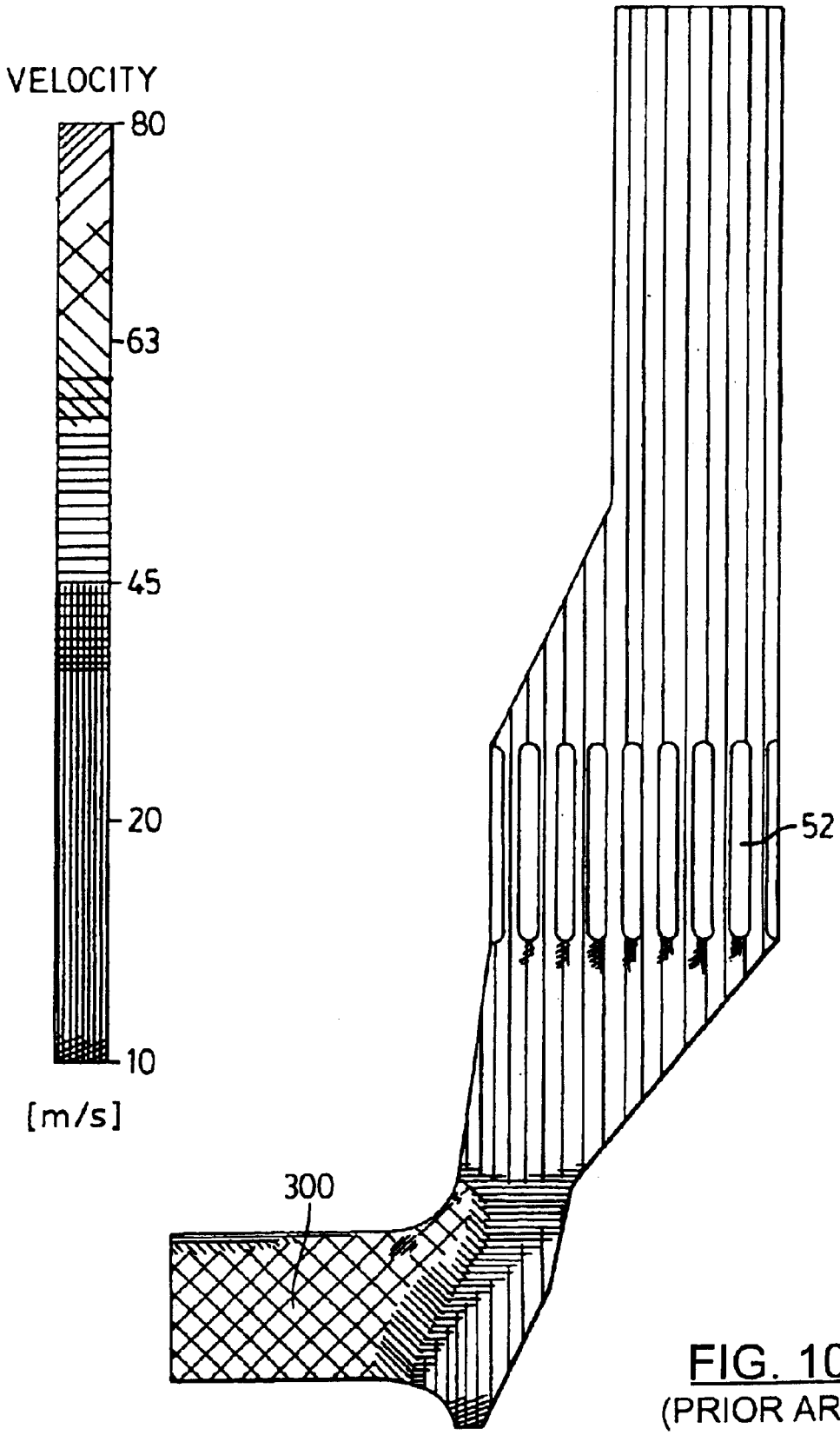
FIG. 10 (PRIOR ART)
FIG. 10 is a schematic side elevation illustrating the velocity of air flow at various locations in the prior art duct.

Turning to the velocity illustrations of FIGS. 10 and 11 a velocity scale extending from 10 to 80 meters per second is shown in the left side of FIG. 10. The hatching provided on FIGS. 10 and 11 indicates that the velocity is substantially uniform and low through the upper regions of both duct units, through the splitters, and in the transition section directly below these splitters. However, the velocity readings are substantially different in the horizontal sections of these two illustrated duct units. In the prior art duct unit of FIG. 10 there is a large region 300 where the velocity of the air is quite high being in the range of 70 to as much as 80 meters per second. The high velocity region 302 is substantially smaller in FIG. 11, particularly as the horizontal portion approaches the fan end. Conversely there is a much larger lower velocity region at 304, the velocity in this area being around 63 meters per second. Again, the more controlled velocity of the air as it approaches the fan in applicant's duct unit helps to eliminate flow induced vibrations and eddies in the flow and this in turn results in less noise being created in the duct unit.

Figure 13:
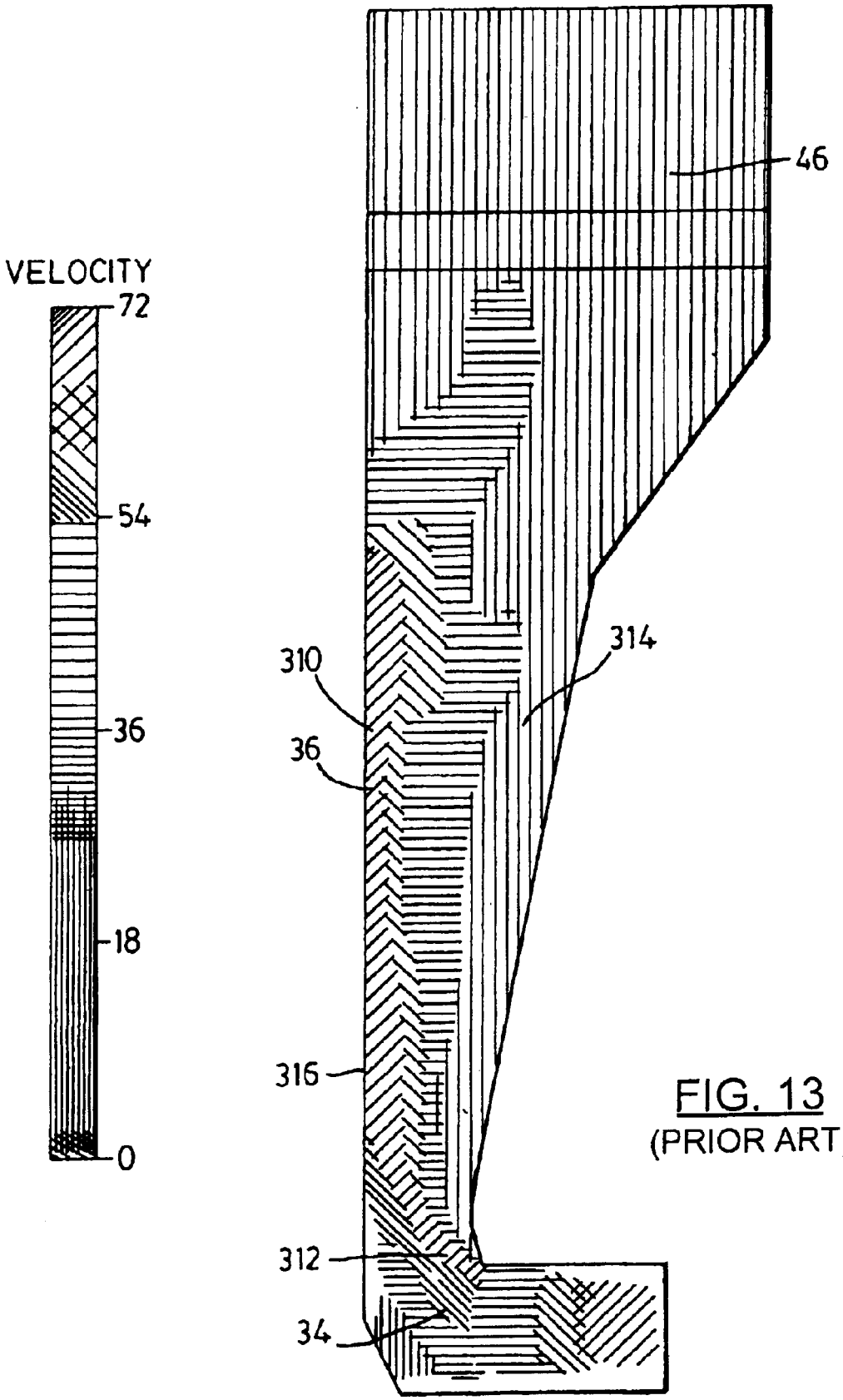
FIG. 13 (PRIOR ART)
FIG. 13 is a schematic side elevation of the prior art connecting duct unit extending between the outlet of a forced draft fan and a boiler unit, this figure being hatched to show velocity distribution according to the scale on the left side of the figure.

FIGS. 13 and 14 illustrate the velocity of the air flow at various locations in the outlet duct apparatus of both the prior art and according to the invention, these duct units being adapted to connect an outlet of the air supply fan 10 to an air heater such as one used in a boiler. On the left side of FIG. 13 is a velocity scale from 0 to 72 meters per second, this scale showing the hatching used to indicate various velocities on the scale. As can be seen clearly from FIG. 13, the velocity distribution varies widely in the connecting duct 36. There is a very high velocity region at 310 that extends vertically a substantial distance from a point 312 located at the bend in the elbow section 34. On the other hand, there is a low volume, low velocity region 314 extending along the right side of the connecting duct for a substantial distance. It is clear from this diagram that with this outlet duct apparatus, the high velocity air from the FD fan produces a blast effect on the inside of the vertically extending wall 316. The reaction here to this high velocity air creates a flow barrier and also very high turbulence in the transmission or connecting section 36 of the duct. On the other hand, with the outlet duct apparatus of the invention, there exists a much lower velocity in the region 318 and there is a much improved flow velocity distribution and flow volume across the width of the connecting duct 230. Thus, with the applicant's outlet duct apparatus, boundary layer separation and turbulence is avoided or reduced.

Figure 15:
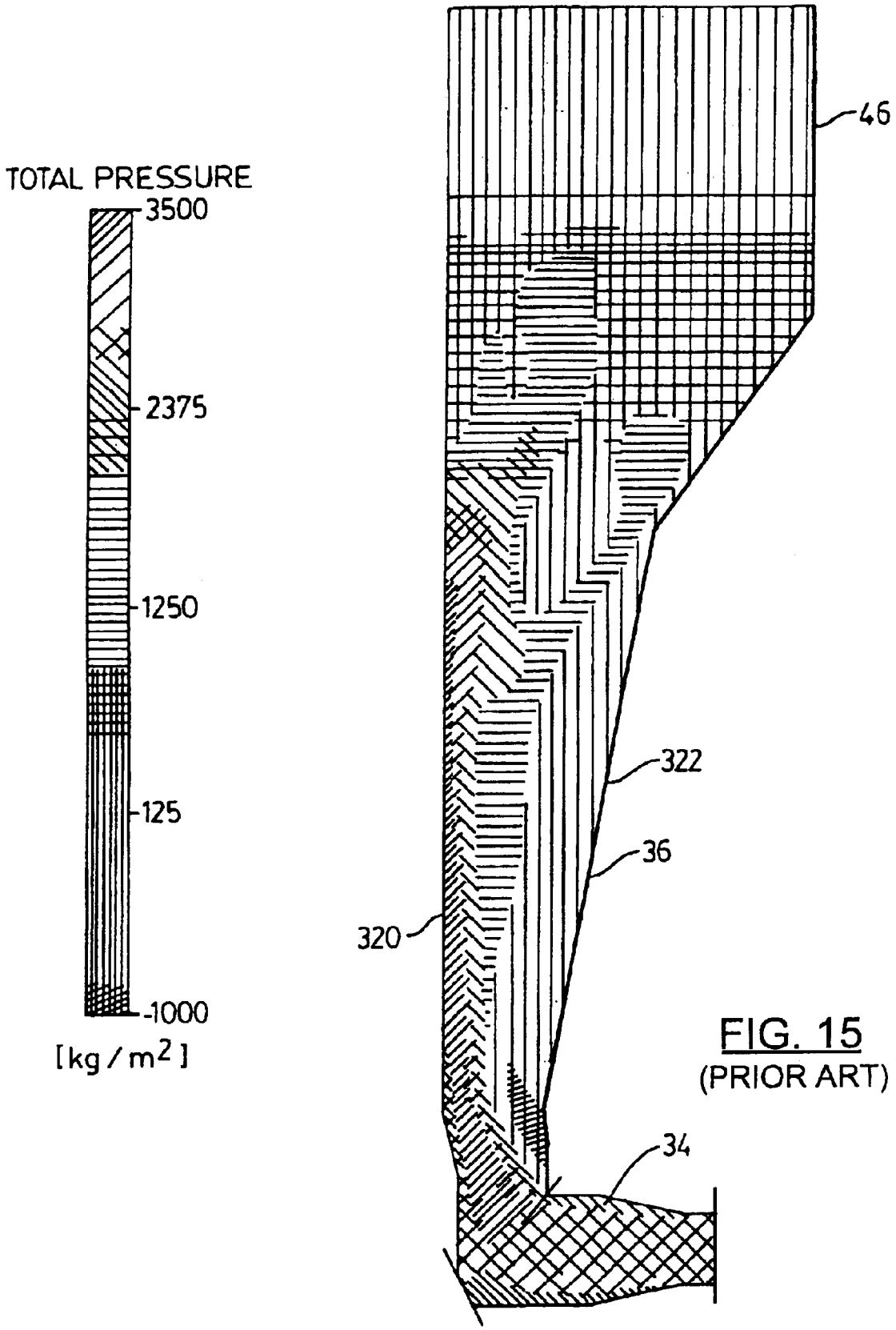
FIG. 15 (PRIOR ART)
FIG. 15 is a schematic illustration of the connecting duct unit shown in FIGS. 1 and 13, this view being hatched to show the total pressure distribution at various locations in the connecting duct unit according to the total pressure scale illustrated on the left side of the figure.

With reference now to FIGS. 15 and 16, these two figures illustrate the total pressure distribution in both the outlet duct apparatus of the prior art and in that of the invention. A total pressure scale from −1,000 to +3,500 is indicated on the left side of FIG. 15, this scale being in units of kilograms per square meter. As illustrated by the hatching in FIG. 15, there is a very high total pressure reading in the elbow section 34, in the order of 2,500 or more kg/m$^2$. There is also a very high total pressure reading along a boundary layer strip 320 with total pressure readings in this strip reaching 3,500 kg/$^2$. However, on the right side of the connecting duct 36 there is a very low pressure region at 322 with total pressure readings in the range of 125 kg/m$^2$.

However, the total pressure distribution is dramatically different in applicant's outlet duct apparatus as indicated by the hatching in FIG. 16. Throughout this outlet duct apparatus, including the elbow section 232, there are no readings in the range of 2,300 or more and, on the other hand, there are only very limited areas in which there are very low total pressure readings. In a central region 324 of the elbow section the total pressure is in the range of about 2,000 kg/m$^2$ and this pressure reading extends up the right side of the turning vane 244. There is a similar intermediate pressure reading in the range of about 2,000 kg/m$^2$ at 326 that starts in the elbow section and continues into the section 238. It is clear from this illustration that applicant's outlet duct apparatus converts the velocity pressure to static pressure regain and provides pressure drop savings in the range of 3 to 4 inches WG.

Accordingly, it is clear that there have been provided by the sound attenuating duct units for delivering air to a fan and by the outlet duct apparatus for connection to an outlet of such a fan constructed in accordance with the invention substantial advantages which can result in operational savings and, in the case of the sound attenuating duct systems, a significant reduction in noise output.

It will be readily apparent to those skilled in the air handling art that various modifications and changes can be made to the duct units and duct apparatus described herein without departing from the spirit and scope of this invention. Accordingly, all such modifications and changes as fall within the scope of the appended claims are intended to be part of this invention.

What is claimed is:

1. A sound attenuating duct unit for delivery of air or gases to an inlet of a fan unit, said duct unit comprising:

an elongate duct for transferring air or gases to said inlet, said duct having duct walls and including a narrow first section, a second, transition-type, expanding section having one end connected to an adjacent end of said first section and an opposite second end, and a relatively wide, sound attenuating third section connected to said second end of the second section, said elongate duct being adapted to extend substantially vertically with said first section on top and said third section at a bottom end thereof, said third section having two opposite first and second side walls that taper towards each other in the direction of air or gas flow through said elongate duct, said direction being downwardly during use of said duct unit, said third section also having a plurality of spaced-apart splitters containing sound attenuating material and having at least two opposing sidewalls made of perforated sheet metal, said splitters being substantially planar, being elongate in said direction of air or gas flow, and being connected to said duct walls, said splitters including at least one central splitter and outer splitters and said outer splitters converging inwardly towards a central longitudinal axis of said third section from their upstream ends to their downstream ends, said central longitudinal axis extending at an acute angle to a vertical axis intersecting said central longitudinal axis; and an elbow-shaped duct section having an upstream end adapted for connection to said third section and a downstream end adapted for connection to said air supply fan unit.

2. A sound attenuating duct unit according to claim 1 wherein said second, expanding section has two opposite side walls that diverge from each other and from said central longitudinal axis in said direction of air or gas flow and that are respectively connected at said opposite second end to said first and second side walls of said third section and wherein both of said opposite side walls of the second section extend at an acute angle to a vertical plane during use of said duct unit.

3. A sound attenuating duct unit according to claim 1, wherein said sidewalls of each of said splitters converge towards one another in said direction of air or gas flow.

4. A sound attenuating duct unit according to claim 1 wherein each of said splitters extends substantially across the width of said third section and said splitters are arranged in a side-by-side manner in said third section.

5. A sound attenuating duct unit according to claim 4, wherein said sound attenuating material is fiberglass batting and there are at least five of said splitters.

6. A sound attenuating duct unit according to claim 1 wherein said elbow-shaped duct section includes a horizontal duct portion connectible to said air supply fan unit and an enlarged end portion that extends below a horizontal plane defined by a bottom of said horizontal duct portion and that has an open top end connected to said third section.

7. A sound attenuating duct unit according to claim 2 wherein said acute angle at which said central longitudinal axis extends is less than 25 degrees.

8. A sound attenuating duct unit according to claim 2 wherein said third section includes a hollow transition region located downstream of said splitters, said two opposite side walls extending along the length of said splitters and along the length of said transition region, and wherein said hollow transition region has a transverse, internal cross-section that is reduced gradually and smoothly in said direction of air or gas flow.

9. A sound attenuating duct unit according to claim 8 wherein said acute angle at which said central longitudinal axis extends is at least 10 degrees and less than 25 degrees.

10. A sound attenuating duct unit for delivery of air or gases to an inlet of an air supply fan unit, said duct unit comprising:

an elongate first duct section for transferring air or gases from an inlet end thereof to an opposite end;

an elongate second duct section having an upstream first end adapted for connection to said opposite end and a downstream second end, said second duct section bending through a smooth curve between said first and said second end, the amount of bending being less than 90 degrees and an upper portion of said second duct section extending substantially vertically during use of said duct unit;

an elongate splitter rigidly mounted in said second duct section, containing sound attenuating material, and having opposite sidewalls made of perforated sheet metal, said splitter extending lengthwise along at least a major portion of said second duct section and located centrally in said second duct section, said splitter also bending through a smooth curve between first and second ends of the splitter, an amount of the bending corresponding proportionally to the bending in said second duct section; and a third duct section having a top opening adapted for connection to said second end of said second duct section during use of said duct unit and having a horizontal portion adapted for connection to said inlet of the air supply fan, wherein said third duct section during use thereof causes a substantial change in direction of flow of said air or gases flowing through said duct unit, said change in direction of flow being less than 90 degrees.

11. A sound attenuating duct unit according to claim 10 including an intake baffle fixedly mounted in said third duct section and extending about a central axis of said horizontal portion of the third duct section, said baffle being spaced radially away from said central axis.

12. A sound attenuating duct unit according to claim 11 wherein said intake baffle contains sound attenuating material and is located in a trap portion of said third duct section arranged between and connected to said second duct section and said horizontal portion during use of said duct unit.

13. A sound attenuating duct unit according to claim 10 wherein said first duct section is longer than said second duct section and extends substantially vertically during use of said duct unit.

14. A sound attenuating duct unit according to claim 10 wherein said third duct section has a trap portion arranged between and connected to said second duct section and said horizontal portion during use of the duct unit, said trap portion having a rounded bottom extending below said horizontal portion during use of said duct unit and an interior air-directing cone with a horizontally extending axis is fixedly mounted in said trap portion.

15. A sound attenuating duct unit according to claim 14 wherein said horizontal portion is cylindrical and open-ended and said trap portion has opposite vertical side walls that are spaced apart a distance greater than the minimum internal diameter of said horizontal portion and a back wall on which said cone is mounted.

16. A sound attenuating duct unit according to claim 10 wherein the amount of bending of the second duct section and the splitter is less than 45 degrees.

17. A sound attenuating duct unit according to claim 10 wherein the amount of bending of the second duct section and the splitter does not exceed 30 degrees.

18. A sound attenuating duct unit according to claim 10 including an intake baffle fixedly mounted in said third duct section, said intake baffle converging inwardly in the direction of flow of the air or gases.

19. A sound attenuating duct unit according to claim 18 wherein said intake baffle contains sound attenuating material and is located in a trap portion of said third duct section arranged between and connected to said second duct section and said horizontal portion during use of said duct unit, said trap portion being adapted to collect any water that enters said duct unit during use thereof.

20. An outlet duct apparatus for connecting an outlet of an air supply fan unit to an air heater unit, said apparatus comprising:

an elbow section of duct for transferring air from an inlet end connectible to said air supply fan unit to an opposite end thereof, said elbow section bending through a smooth curve between said inlet end and said opposite end, the amount of bending being more than 60 degrees;

an elongate second section of duct having an upstream first end connected to said opposite end of the elbow section and-having a downstream second end which is wider than said first end and is connectible to said air heater unit during use of the outlet duct apparatus for delivery of combustion air through an air inlet for said air heater unit; and a turning vane rigidly mounted in said outlet duct apparatus and having a curved first vane section located centrally in said elbow section and an adjoining second vane section located in said second section of duct, said second section of duct and said second vane section extending upwardly during use of the outlet duct apparatus, wherein there is a smooth transition between said first and second vane sections on both a front side and rear side of the turning vane.

21. An outlet duct apparatus according to claim 20 wherein said elbow section bends through a curve of about 90 degrees, said turning vane also bends through a curve of about 90 degrees from a leading edge of said turning vane to a trailing edge thereof, and said second vane section extends at least a major portion of the length of said second section of duct.

22. An outlet duct apparatus according to claim 20 wherein said turning vane contains sound attenuating material and has opposite curved sides made of perforated sheet metal which covers the sound attenuating material.

23. An outlet duct apparatus according to claim 22 wherein said turning vane varies gradually in thickness along its length and has a narrow, horizontally extending leading edge and a thicker, curved region that extends through a downstream portion of said elbow section of duct and into an upstream portion of the second section of duct, and then to a tapering region where front and rear sides of the vane converge towards each other up to a trailing edge of the turning vane.

24. An outlet duct apparatus according to claim 21 wherein said turning vane extends across the width of both the elbow section and the second section of duct.

25. An outlet duct apparatus according to claim 20 wherein said elbow section includes an outside curved side wall and an opposite inside curved side wall and said second section of duct includes a straight inner sidewall and an opposing straight outer side wall, the straight inner side wall being a smooth extension of said inside curved side wall and the straight outer side wall being a smooth extension of said outside curved side wall, and wherein said straight outer side wall extends in a vertical plane while said straight inner side wall extends at a small acute angle to said vertical plane so as to diverge away from said straight outer side wall in an upwards direction.

26. An outlet duct apparatus according to claim 25 wherein said second vane section extends at least a major portion of the length of said second section of duct and bends slightly towards said inner side wall from its bottom end to the trailing edge of the turning vane.

27. An outlet duct apparatus according to claim 21 wherein both said elbow section of duct and said second section of duct are internally lined with sound attenuating material covered by perforated sheet metal interior walls.

28. An outlet duct apparatus according to claim 22 wherein both said elbow section of duct and said second section of duct are internally lined with sound attenuating material covered by perforated sheet metal interior walls.

29. An outlet duct apparatus according to claim 28 wherein said sound attenuating material located in said turning vane and lining said elbow section and said second section of duct comprises mineral wool covered by polyester plastic sheets.

* * * * *

UNITED STATES PATENT AND TRADEMARK OFFICE

CERTIFICATE OF CORRECTION

PATENT NO. : 6,920,959 B2
DATED : July 26, 2005
INVENTOR(S) : Han et al.

It is certified that error appears in the above-identified patent and that said Letters Patent is hereby corrected as shown below:

Title page,
Item [75], Inventors, correct last name of second inventor to read -- Gaur --.

Column 16,
Line 50, delete "is" at end of the line.

Signed and Sealed this

Eighteenth Day of April, 2006

JON W. DUDAS
*Director of the United States Patent and Trademark Office*